US006059041A

United States Patent [19]

Scott

[11] Patent Number: 6,059,041

[45] **Date of Patent: *May 9, 2000**

[54] APPARATUS AND METHODS FOR ACHIEVING LOCK-OUT OF A DOWNHOLE TOOL

[75] Inventor: Gordon K. Scott, Dallas, Tex.

[73] Assignee: Halliburton Energy Services, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,853

[22] Filed: Jul. 17, 1997

[51] Int. Cl.[7] ..... E21B 34/10

[52] U.S. Cl. ..... 166/373; 166/323

[58] Field of Search ..... 166/373, 377, 166/386, 323, 217

[56] References Cited

U.S. PATENT DOCUMENTS

| | | | |
|---|---|---|---|
| 654,875 | 7/1900 | Cook | 166/217 |
| 3,786,865 | 1/1974 | Tausch et al. | 166/323 |
| 3,786,866 | 1/1974 | Tausch et al. | 166/323 |
| 3,882,935 | 5/1975 | Calhoun | 166/323 |
| 3,948,318 | 4/1976 | Page, Jr. | 166/323 |
| 4,344,602 | 8/1982 | Arendt | 166/323 |
| 4,437,522 | 3/1984 | Krause, Jr. et al. | 166/217 |
| 4,457,368 | 7/1984 | Knierimen et al. | 166/217 |
| 4,569,404 | 2/1986 | Milberger et al. | 166/217 |
| 4,574,889 | 3/1986 | Pringle | 166/323 |
| 4,577,694 | 3/1986 | Brakhage, Jr. . | |
| 4,624,315 | 11/1986 | Dickson et al. | 166/323 |
| 4,967,845 | 11/1990 | Shirk | 166/323 |
| 5,167,284 | 12/1992 | Leismer | 166/323 |
| 5,249,630 | 10/1993 | Meaders et al. | 166/323 |
| 5,348,087 | 9/1994 | Williamson et al. | 166/217 |
| 5,492,173 | 2/1996 | Kilgore et al. . | |
| 5,826,657 | 10/1998 | Ringgenberg | 166/323 |

OTHER PUBLICATIONS

Publication: Baker Subsurface Safety Systems Catalog, Front cover and p. 13, dated 1995.

Halliburton Wellstar™TRSV Lock Open Tool, drawing CN03930, undated.

Halliburton 2.813 Lock–out Tool F/3–1/2 Wellstar TRSV, drawing 42 Lox 38101, dated Jan. 30, 1996.

*Primary Examiner*—William Neuder

*Attorney, Agent, or Firm*—William M. Imwalle; Marlin R. Smith; J. Richard Konneker

[57] ABSTRACT

Apparatus and associated methods provide convenient and reliable deposition of a radially deflectable blocking member relative to a downhole tool. In a described embodiment of the apparatus, a lock-out tool has mechanisms which effect latching of the tool to an internal profile of a safety valve, displacement of an opening prong of the safety valve to open the safety valve, and deposition of an expandable ring to prevent closure of the safety valve. The ring is accurately positioned by the tool and is constructed in a manner which enables it to resist relatively large axial loads, but which also enable it to be significantly radially compressed.

69 Claims, 19 Drawing Sheets

APPARATUS AND METHODS FOR ACHIEVING LOCK-OUT OF A DOWNHOLE TOOL

BACKGROUND OF THE INVENTION

The present invention relates generally to operations involving tools, such as safety valves, etc., installed in subterranean wells and, in an embodiment described herein, more particularly provides apparatus and methods for achieving secondary lock-out of such safety valves.

It is sometimes desired to lock-out a safety valve, that is, to prevent closure of the safety valve, after it has been installed in a subterranean well. Among the reasons for locking-out the safety valve may be that the safety valve has ceased to function properly, or operations are to be performed through the safety valve and its closure during those operations is to be prohibited. If the safety valve is malfunctioning, the lock-out operation may also establish fluid communication between a control line attached to the safety valve and extending to the earth's surface, and a second, typically wireline-conveyed, safety valve subsequently landed in the malfunctioning safety valve. This operation, in which a safety valve is prevented from closing and fluid communication is established with the safety valve's control line, is sometimes referred to as a "primary" lock-out.

In another type of lock-out, a second control line-operated safety valve is not to be installed, so it is not necessary or desired to establish fluid communication with a control line. This operation, in which a safety valve is prevented from closing, but fluid communication is not established with the safety valve's control line, is sometimes referred to as a "secondary" lock-out. Another safety valve which does not use control line pressure in its operation, such as a tubing-pressure or velocity-type safety valve, may or may not be subsequently installed to replace the locked-out safety valve. In any event, such secondary lock-out operation permits remedial operations to be performed in the well, without the danger of the safety valve inadvertently closing on a wireline, coiled tubing, or during an acidizing treatment, etc.

Some safety valves, such as the SP-1™ safety valve manufactured by, and available from, Halliburton Energy Services of Duncan, Okla., are initially equipped with built-in features that facilitate convenient lock-out operations. However, other safety valves, such as Halliburton Energy Services' WELLSTAR® safety valve, do not include such features and, thus, a lock-out operation for these safety valves typically involves use of a specially designed tool. The tool is usually positioned within the safety valve and a mechanism of the tool is actuated to prevent closure of the safety valve.

One type of specially designed tool used for secondary lock-out of a safety valve deposits an expandable ring within the safety valve, in order to maintain a flapper of the safety valve in an open position. The expandable ring is deposited within the safety valve so that the ring contacts the flapper and overcomes the biasing force of a spring acting to close the flapper. Unfortunately, due to design restrictions of the tool, the ring is very thin in cross-section and, thus, potentially weak and unreliable, the ring may extend inwardly into an axial flow passage of the tool and interfere with subsequent operations therein, and the ring is susceptible to damage and dislodgement if the safety valve is inadvertently operated by applying fluid pressure to its control line.

Another type of specially designed tool used for secondary lock-out of a safety valve deposits an expandable ring within the safety valve between an opening prong of the valve and an internal shoulder to thereby prevent the opening prong from displacing to a position in which the valve will be permitted to close. The tool is latched into the opening prong and tubing pressure is applied to a tubing string attached above the safety valve in order to displace the opening prong to a position in which the valve is open, and then to deposit the expandable ring. Unfortunately, it is possible for the ring to be deposited in the wrong location since it is latched to the movable opening prong and a shear pin which determines the pressure at which the ring is deposited may shear before the opening prong has been fully displaced to the open position. Additionally, due to design restrictions, the ring is very thin in cross-section and weak.

From the foregoing, it can be seen that it would be quite desirable to provide an apparatus for achieving lock-out of a safety valve which does not utilize a thin or weak expandable ring and which is not located relative to a moveable point of reference during its operation, but which prevents closure of the safety valve by depositing an expandable ring within the valve. Additionally, it would be desirable to provide an expandable ring for use with the apparatus that is structurally sound in axial compression, but that is capable of significant radial expansion and contraction. Furthermore, it would be desirable to provide the apparatus with features that prevent deposition of the ring when the apparatus is not actuated properly, enable the ring to be safely retrieved with the apparatus in the event that the apparatus has been only partially, or improperly, actuated, and which indicate upon retrieval to the earth's surface whether the apparatus has been properly actuated. Methods of achieving lock-out of a safety valve which ensure convenient and reliable operations in preventing closure of the safety valve would also be desirable.

Still further, it would be desirable to provide an apparatus which is capable of depositing a radially displaceable ring with respect to any of a variety of downhole tools. For example, tools such as packers, sliding side doors, plugs, etc. may have one or more members disposed therein which are displaceable to set or unset, open or close, or otherwise operate the tools. Such an apparatus may be used to limit displacement of these members. Alternatively, the deposition of a radially displaceable ring relative to a downhole tool may be used for other purposes, for example, to centralize a packer, plug, etc. within a wellbore prior to setting it therein.

SUMMARY OF THE INVENTION

In carrying out the principles of the present invention, in accordance with a described embodiment thereof, an apparatus is provided which is capable of accurately and reliably depositing a structurally sound radially displaceable ring within a safety valve or other downhole tool. The expandable ring has structural capabilities which are far superior to any previous expandable rings utilized in lock-out mechanisms. Methods of achieving lock-out of a safety valve are also provided.

In broad terms, an apparatus is provided which locates and locks relative to a fixed reference, such as a profile formed in a portion of a body of a safety valve. The apparatus also includes a set of dogs which extend radially outward and engage an opening prong of the valve upon application of an axial force to the apparatus. Thereafter, fluid pressure applied to the apparatus causes the opening prong to displace and open the safety valve. Further application of fluid pressure releases a radially compressed expandable ring, so that it is deposited in a recess between the opening prong and an internal shoulder of the safety valve.

After the ring is deposited, an indication of proper actuation of the apparatus is provided by an equalization of fluid pressure across the apparatus, which may be detected at the earth's surface. In the event that the apparatus has not been actuated properly, the expandable ring is not deposited. In order to ensure that the ring is not deposited improperly, a mechanism of the apparatus which deposits the ring is directly tied to a mechanism of the apparatus which displaces the opening prong.

The ring depositing mechanism retains the expandable ring therein during transport to the earth's surface, in the event that the apparatus has partially, or improperly, actuated. Additionally, the ring depositing mechanism provides a positive indication of proper actuation of the apparatus.

A disclosed and described embodiment of the expandable ring includes a series of circumferentially spaced apart cantilevers. The cantilevers are joined to each other at opposite ends of the ring, with the ring being continuous. When the ring is radially compressed, the cantilevers are deflected circumferentially, thereby decreasing the ring's circumference. In this manner, significant radial compression of the ring is achieved, while maintaining significant ability to resist axially compressive loads applied thereto.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
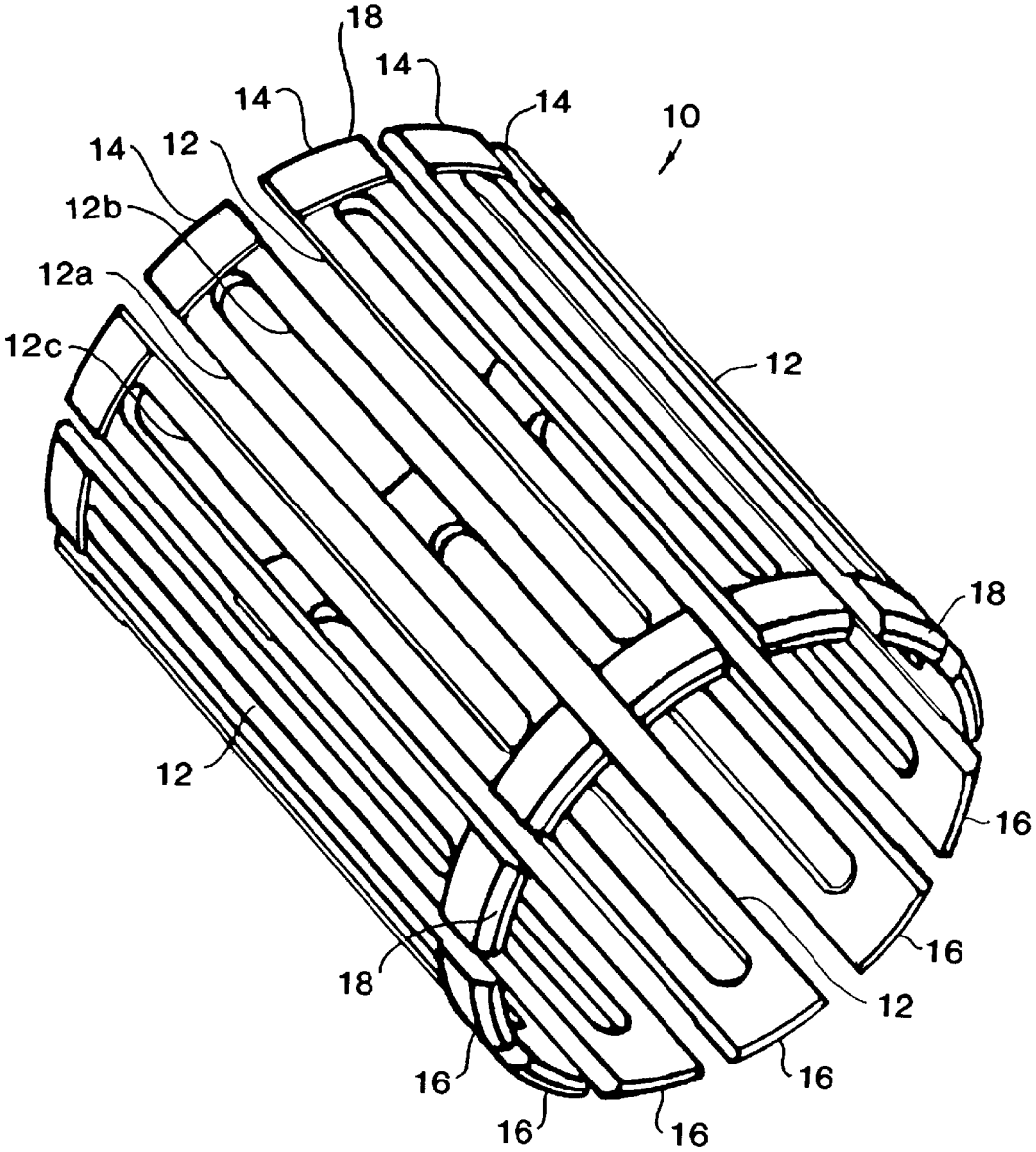
FIG. 1 is an isometric view of a radially deflectable ring embodying principles of the present invention.

Representatively illustrated in FIG. 1 is a radially deflectable ring 10 which embodies principles of the present invention. In the following description of the ring 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The ring 10 is uniquely formed in a circumferentially continuous manner. To accomplish this construction, a series of circumferentially spaced apart cantilevers 12 are attached to each other at opposite ends. Thus, a particular cantilever 12*a* is attached at one of its opposite ends to another circumferentially adjacent cantilever 12*b*, and is attached at its other opposite end to another circumferentially adjacent cantilever 12*c*. In this manner, the cantilever 12*a* is disposed circumferentially between the cantilevers 12*b* and 12*c*, and is attached to each of them.

Each of the cantilevers 12 is attached to two others of the cantilevers, progressing circumferentially about the ring 10. Thus, the ring 10 is circumferentially continuous, with there being no complete axial break between any adjacent pair of the cantilevers 12. The applicant prefers that the ring 10 described herein be circumferentially continuous in order to evenly distribute stresses and resulting deflection throughout the ring, however, it is to be clearly understood that a ring including a series of circumferentially spaced apart cantilevers could be constructed in accordance with the principles of the present invention without that ring being circumferentially continuous.

In the representatively illustrated ring 10, the cantilevers 12 are attached at their opposite ends utilizing a series of circumferentially spaced apart segments 14, 16. One series of segments 14 is attached at one axial end of the cantilevers 12, and the other series of segments 16 is attached at the other axial end of the cantilevers. In this manner, each one of the cantilevers 12 is attached at one of its ends to one of the segments 14, and is attached at the other one of its ends to one of the segments 16. Each one of the segments 14, 16 is attached to two circumferentially adjacent cantilevers 12.

Since the segments 14 are circumferentially spaced apart from each other, and the segments 16 are circumferentially spaced apart from each other, the ring 10 may be radially deflected to, for example, radially compress the ring, by forcing the segments circumferentially toward each other. Of course, the ring 10 may also be radially expanded by forcing the segments 14, 16 further circumferentially apart from each other.

Figure 2A:
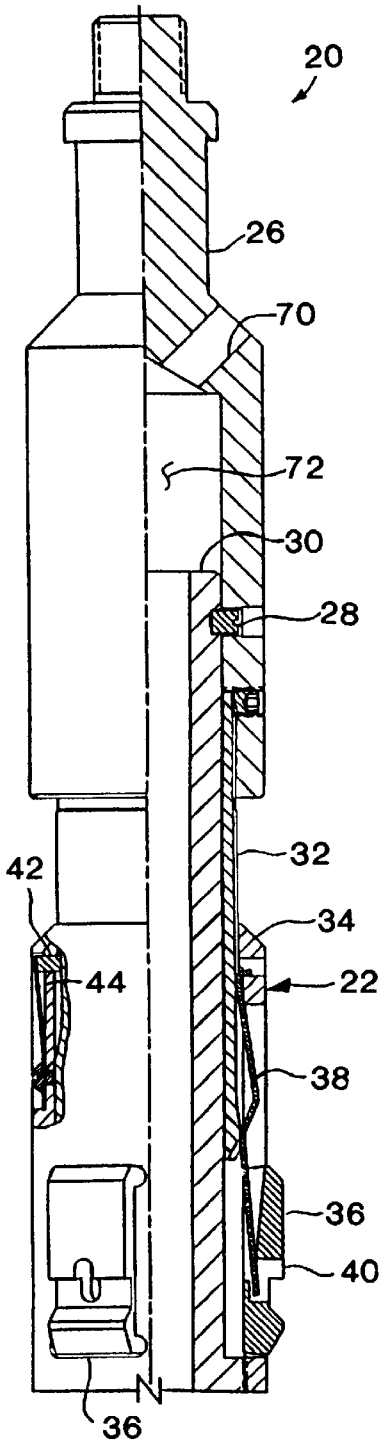
FIGS. 2A–2D are quarter-sectional views of successive axial sections of a lock-out tool embodying principles of the present invention, the lock-out tool being shown in a configuration in which it is initially run into a subterranean well in an operation to lock-out a safety valve installed therein.
Figure 2B:
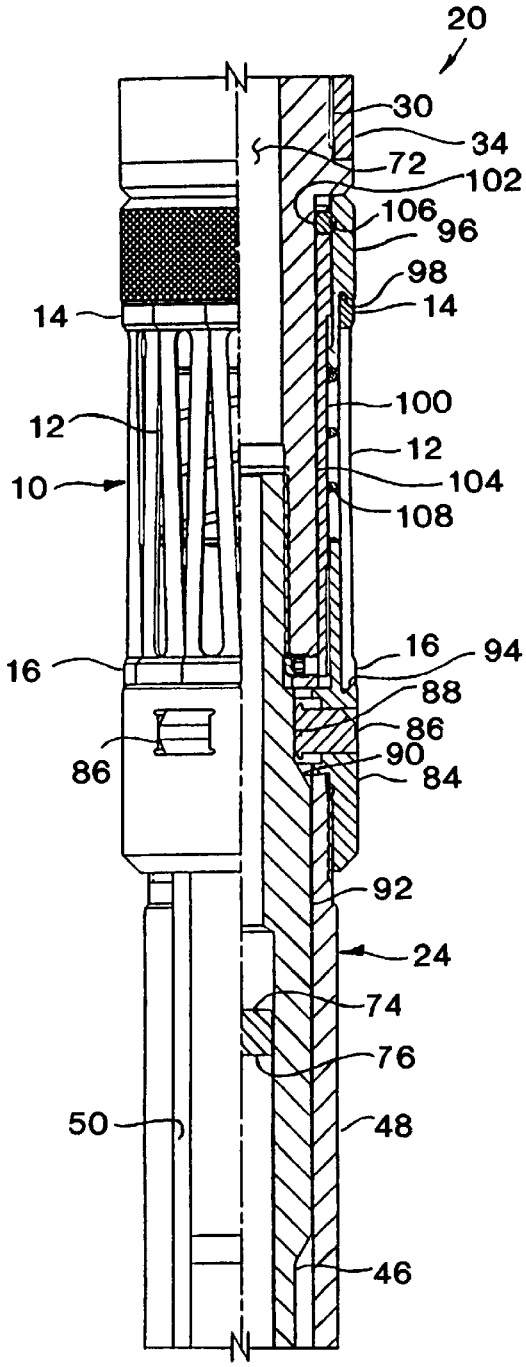

When the circumferential spacing between the segments 14, 16 is altered by, for example, forcing the segments circumferentially toward each other, the cantilevers 12 are laterally deflected from their at rest positions as shown in FIG. 1. Referring momentarily to FIG. 2B, the ring 10 is representatively illustrated installed in a lock-out tool 20, wherein the ring is radially compressed, thereby forcing the segments 14, 16 circumferentially toward each other. Note that each of the cantilevers 12 is laterally deflected and does not extend perfectly axially as compared to the cantilevers shown in FIG. 1. It is to be clearly understood that it is not necessary in keeping with the principles of the present invention for the cantilevers 12 to extend perfectly axially in their free states, for example, the cantilevers may extend spirally or helically between the segments 14, 16. However, the applicant prefers that the cantilevers 12 be laterally deflectable without causing yielding of, or other damage to, the cantilevers, so that the ring 10 will be capable of being radially compressed and then released for radial expansion when desired.

The segments 14, 16 are generally annular shaped and are somewhat radially enlarged relative to the cantilevers 12, and have externally sloped end portions 18 formed thereon. In a manner that will be more fully described hereinbelow, the ring 10 is radially inwardly retained in a radially inwardly compressed configuration at the end portions 18 when installed in the tool 20. However, it is to be clearly understood that it the segments 14, 16 may be other than annular shaped, may not be radially enlarged, and may include otherwise shaped end portions, without departing from the principles of the present invention.

The applicant has found through experimentation that a prototype of the ring 10 is capable of resisting very large axially compressive loads, and may be significantly radially compressed from its free state. Since the cantilevers 12 are permitted to deflect laterally along their entire axial lengths without yielding, the ring 10 returns to its free state without taking a "set" after being radially compressed. Furthermore, due to its circumferentially continuous construction, the ring 10 may easily be radially compressed, returned to its free state, radially extended, etc., while maintaining a generally cylindrical shape. The above benefits make the ring 10 particularly suitable for use in a lock-out tool, such as the lock-out tool 20 described hereinbelow, although the ring may also be used in other tools, devices, etc., without departing from the principles of the present invention.

Although the ring 10 has been described herein with reference to the illustrated representative embodiment shown in the figures, it is to be understood that changes may be made thereto without departing from the principles of the present invention. For example, instead of the ring 10 being generally cylindrical or annular-shaped, it may actually be elliptical or polygonal in lateral cross-section, the segments 14, 16 may be otherwise shaped and may not be utilized at all, the cantilevers 12 may be otherwise attached to each other, etc. Such changes are contemplated by the principles of the present invention.

Referring additionally now to FIGS. 2A–2D, the lock-out tool 20 embodying principles of the present invention is representatively illustrated. The lock-out tool 20 is described herein as it may be utilized in a secondary lock-out of a subterranean safety valve, but it is to be understood that a lock-out tool constructed in accordance with the principles of the present invention may be used in other operations. For example, a lock-out tool constructed in accordance with the principles of the present invention may be utilized in a primary lock-out operation. As another example, a tool constructed in accordance with the principles of the present invention may be used to deposit a radially displaceable ring with respect to a packer, plug, sliding side door, or other downhole tool.

As representatively illustrated, the lock-out tool 20 includes a latch mechanism 22, a displacement mechanism 24, and a blocking member, representatively, the ring 10. Blocking members other than the ring 10 may be used in the tool 20 without departing from the principles of the present invention. In the tool 20, the latch mechanism 22 is used to releasably secure the tool relative to a safety valve, and the displacement mechanism 24 is used to displace an actuator member of the safety valve to thereby open the valve. The blocking member 10 is then deposited in the safety valve to restrict displacement of the actuator member, thereby preventing closure of the safety valve. Displacement of the actuator member and deposition of the blocking member 10 are achieved by applying fluid pressure to the tool 20. In the following description of the tool 20, the construction of each of the mechanisms will first be detailed, and then use of the tool in a secondary lock-out operation will be described.

The latch mechanism 22 includes an upper head 26. The upper head 26 facilitates threaded attachment of the tool 20 to a conveyance, such as a wireline, slickline, coiled tubing, etc. In addition, an axially downwardly directed force may be applied to the upper head 26 to shear a shear screw 28 installed radially therethrough and into a generally tubular latch mandrel 30. Such force may be applied by jarring down on the upper head 26 in a conventional manner after the tool 20 has been positioned within the safety valve as described more fully hereinbelow.

The upper head 26 is threadedly attached to a generally tubular key support 32, which is axially slidingly disposed about the latch mandrel 30. When the shear screw 28 is sheared, the upper head 26 and key support 32 are permitted to displace axially downward relative to the latch mandrel 30. Furthermore, the key support 32 is permitted to displace downward relative to a generally tubular key retainer 34 and a series of circumferentially spaced apart keys 36 extending radially through the key retainer.

Each of the keys 36 is biased radially outward by a spring 38. The keys 36 have an external profile 40 formed thereon which is complementarily shaped relative to an internal profile formed within, or attached to, the safety valve. As described more fully hereinbelow, when the tool 20 is conveyed into the safety valve, the keys 36, biased outward by the springs 38, engage the internal profile and prevent further downward displacement of the tool. The downwardly directed force may then be applied to the upper head 26 to shear the shear pin 28 and downwardly displace the upper head and key support 32.

When the key support 32 is downwardly displaced relative to the key retainer 34 and keys 36, it will radially outwardly support the keys 36, so that the keys cannot disengage from the internal profile of the safety valve. Additionally, a shear pin 42 extending radially through the key retainer 34 will displace radially inwardly, due to a biasing force exerted by a spring 44, into a groove (not shown) formed externally on the key support 32 to thereby prevent upward displacement of the key support relative to the key retainer. In order to disengage the keys 36 from the safety valve internal profile, an upwardly directed force is applied to the upper head 26 to shear the shear pin 42 and thereby permit the key support 32 to be displaced axially upward, so that it no longer radially outwardly supports the keys 36.

The latch mandrel 30 is threadedly attached at its lower end to a generally tubular expander sleeve 46. The expander sleeve 46 extends radially outwardly through a shear sleeve 48 of the displacement mechanism 24 at a series of circumferentially spaced apart and axially extending slots 50 formed through the shear sleeve. The shear sleeve 48 is, thus, axially displaceable relative to the expander sleeve 46, even though the lower end of the expander sleeve extends radially through the shear sleeve.

The expander sleeve 46 is threadedly attached to a generally tubular spring housing 52 where the expander sleeve extends radially through the shear sleeve 48. The spring housing 52 is threadedly attached to a generally tubular piston housing 54. The piston housing 54 is threadedly attached to a generally tubular bottom nose 56, thereby axially retaining a circumferential seal, representatively, a packing stack 58, externally thereon.

When the tool 20 is conveyed into the safety valve as described more fully hereinbelow, the seal 58 will sealingly engage an internal seal bore within, or attached to, the safety valve. Such sealing engagement will preferably occur at, or just prior to, engagement of the keys 36 with the safety valve internal profile. Thus, when the latch mechanism 22 releasably secures the tool 20 within the safety valve, the tool is also sealingly engaged therewith. Note that the axial distance between the keys 36 and seal 58 preferably remains constant during the lock-out operation, but it is to be clearly understood that it is not necessary for this distance to remain constant in a lock-out tool constructed in accordance with the principles of the present invention.

The shear sleeve 48 is releasably secured against axial displacement relative to the latch mechanism 22 by one or more shear screws 60 (only one of which is visible in FIG. 2C) installed radially through the spring housing 52 and into the shear sleeve. An annular piston 62 is axially slidingly and sealingly engaged within a piston bore 64 of the piston housing 54. The piston 62 is axially retained and sealingly engaged on a generally tubular piston sleeve 66 by a generally tubular cap 68, which is threadedly attached to the piston sleeve. The piston sleeve 66 is, in turn, threadedly attached to the shear sleeve 48, thereby effectively attaching the piston 62 to the shear sleeve. As will be more fully described hereinbelow, when a predetermined fluid pressure is applied across the piston 62, the shear screw 60 will shear, thereby permitting the displacement mechanism 24 to downwardly displace relative to the latch mechanism 22.

Fluid pressure is applied across the piston 62 in operation of the tool 20 after the seal 58 has sealingly engaged the safety valve seal bore. Fluid pressure may then be applied to a tubing string from which the safety valve is suspended at the earth's surface. The fluid pressure will enter one or more ports 70 and pass into an axial fluid passage 72 which extends through the tool 20.

The fluid passage 72 is blocked in the tool 20 as shown in FIGS. 2A–2D by a generally cylindrical drop 74. The drop 74 is axially slidingly received within the expander sleeve 46. A generally axially extending slot 76 is formed through the drop. A screw 78 is installed laterally through the slot 76 and is secured to the expander sleeve 46. Thus, cooperative engagement of the screw 78 in the slot 76 limits axial displacement of the drop 74 relative to the expander sleeve 46.

Figure 2C:
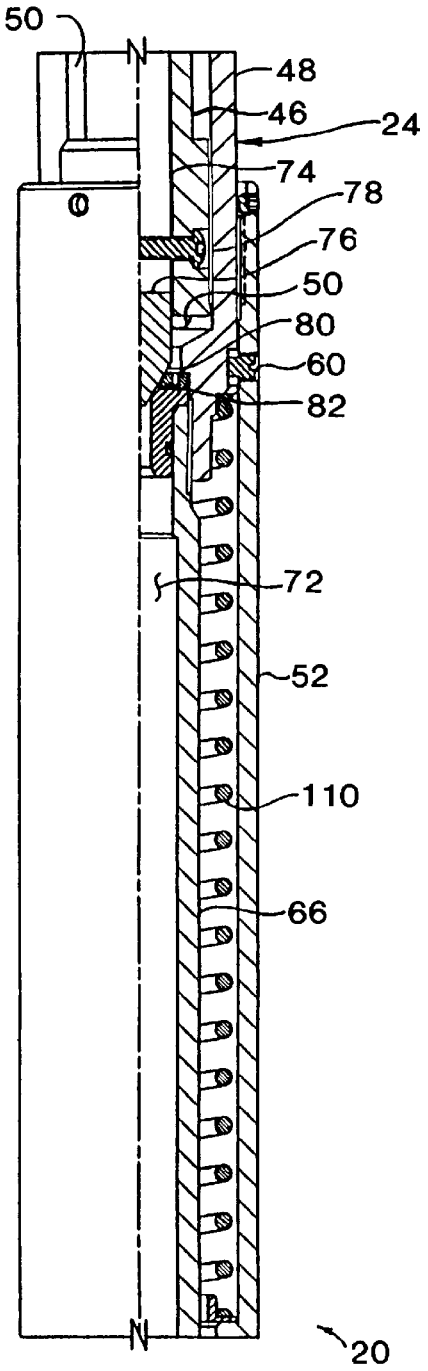
Figure 2D:
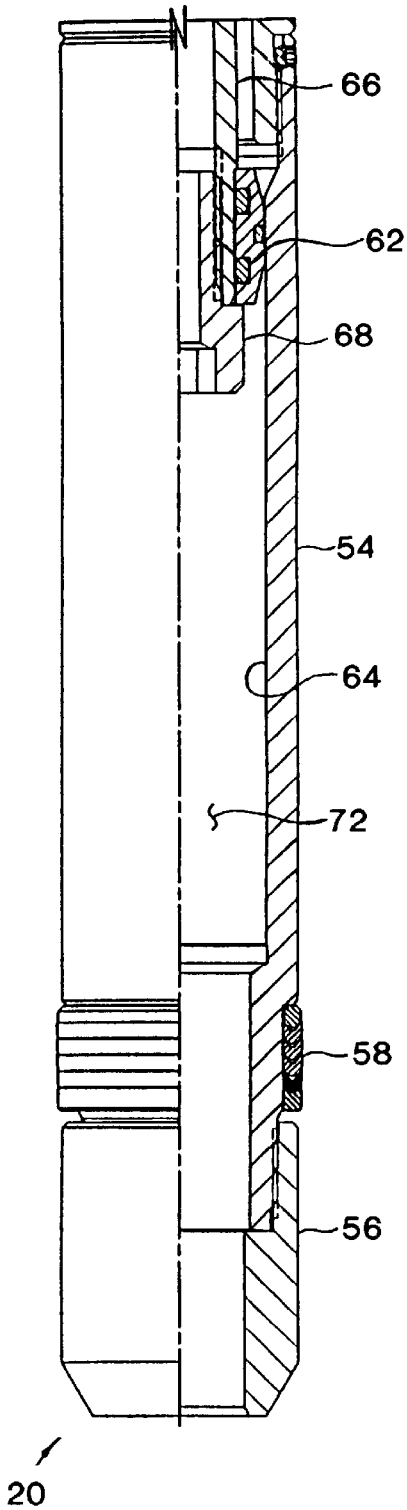
Figure 3A:
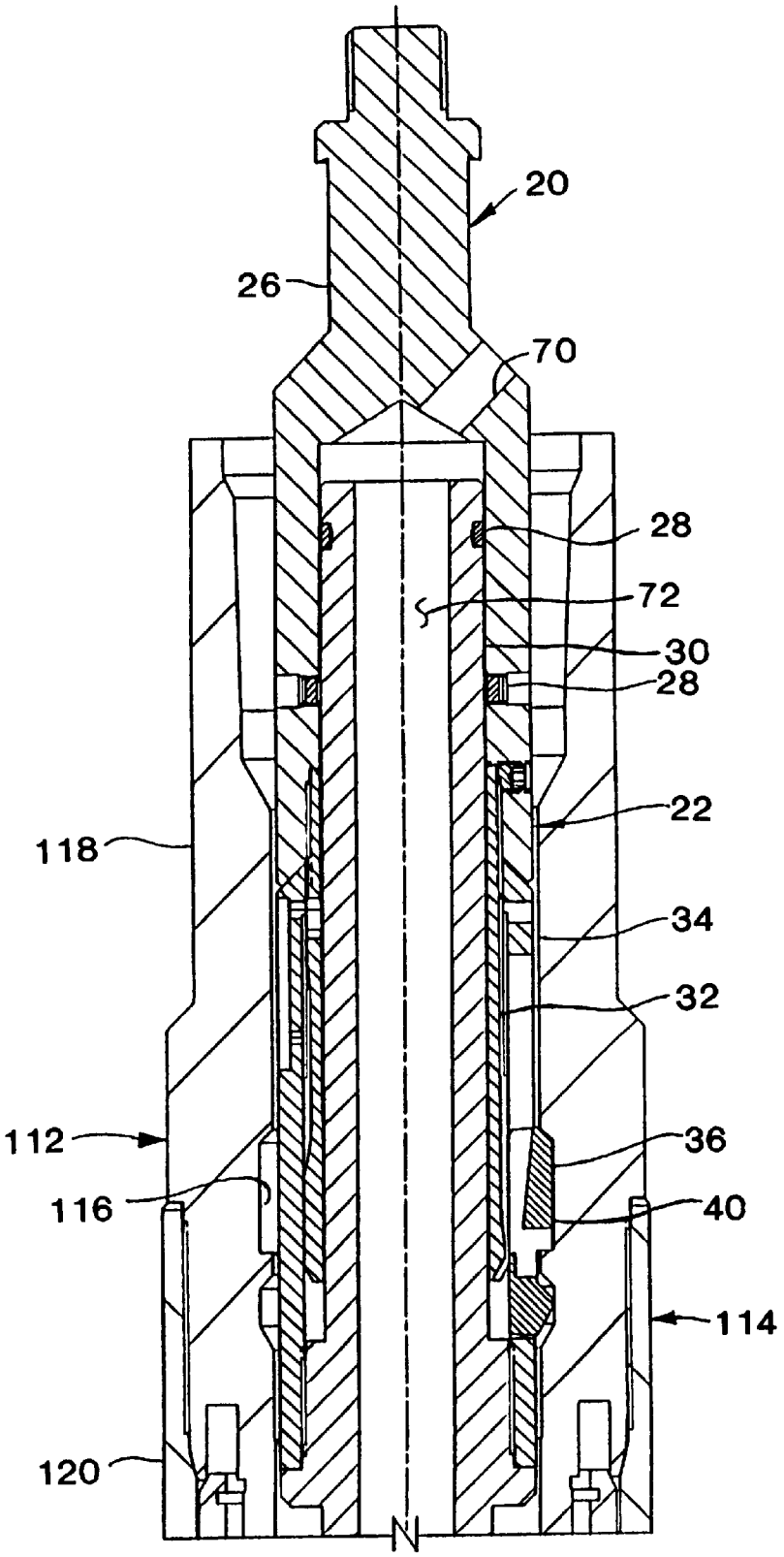
FIGS. 3A–3D are cross-sectional views of successive axial sections of the lock-out tool of FIGS. 2A–2D, the lock-out tool being shown in a configuration in which it has been secured to, and sealingly engaged with, the safety valve, and initial fluid pressure has been applied to cause the lock-out tool to engage an actuator member of the safety valve.
Figure 3B:
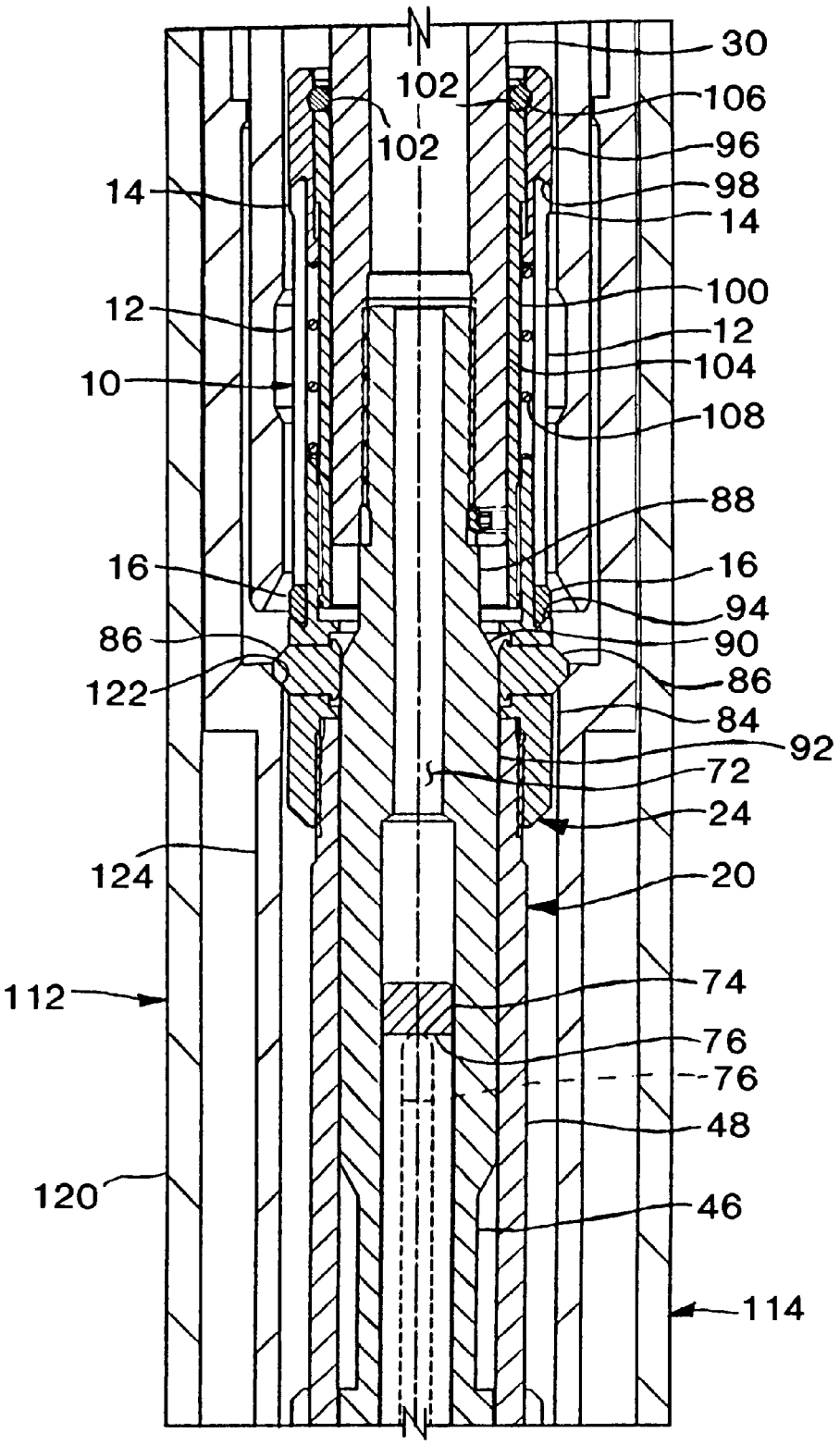
Figure 3C:
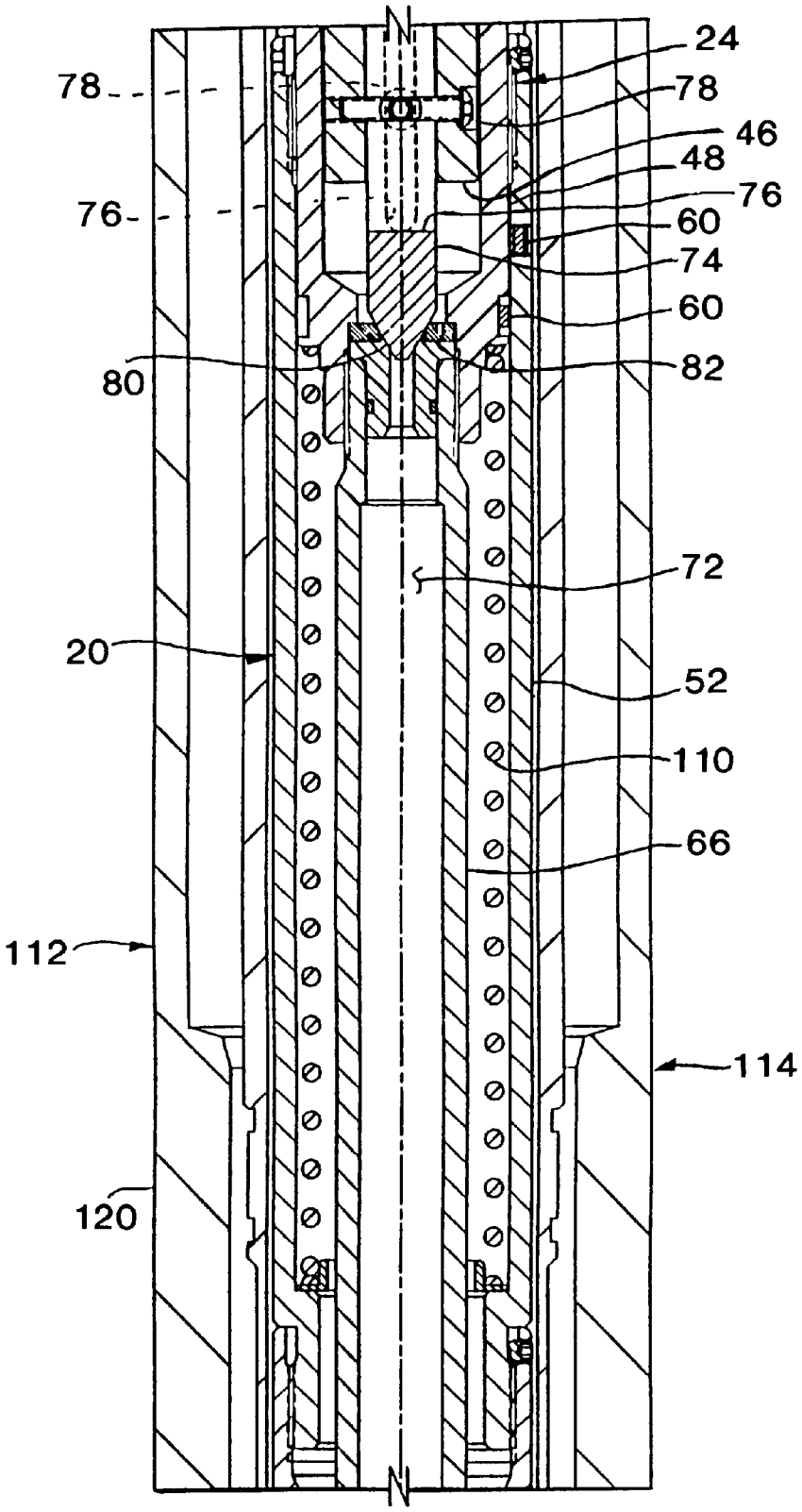
Figure 3D:
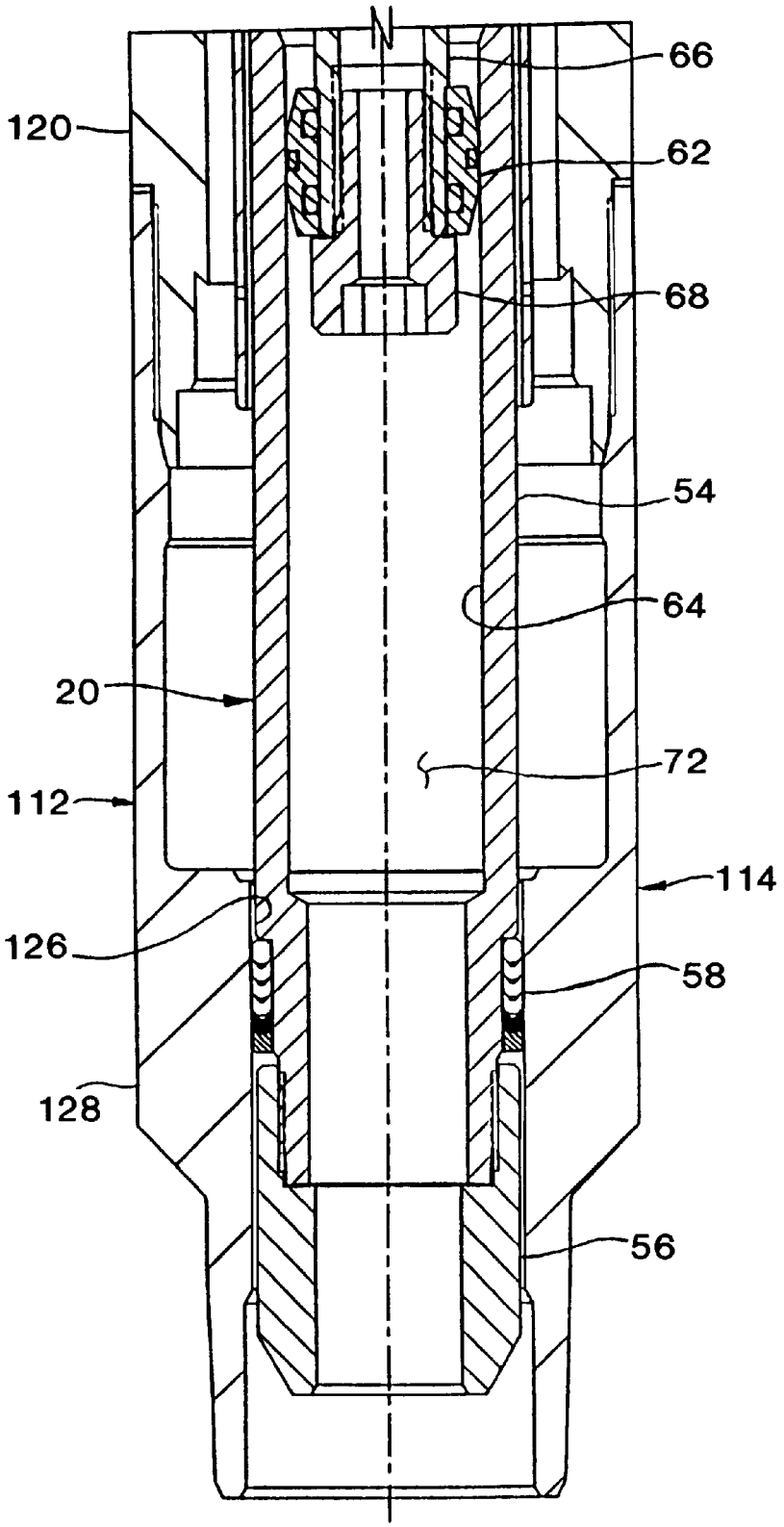
Figure 4A:
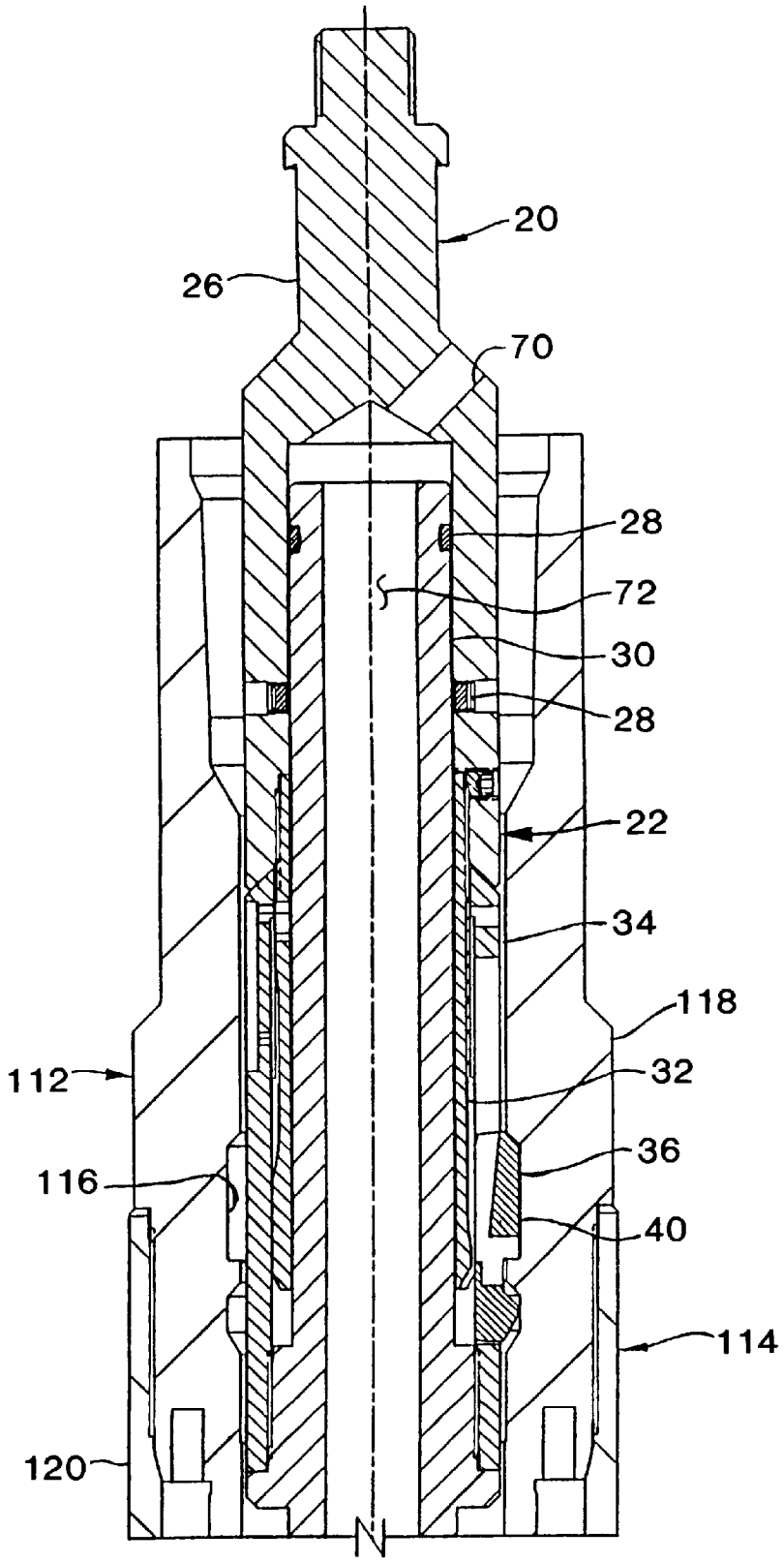
FIGS. 4A–4D are cross-sectional views of successive axial sections of the lock-out tool of FIGS. 2A–2D, the lock-out tool being shown in a configuration in which additional fluid pressure has been applied to cause the lock-out tool to displace the actuator member and open the safety valve.
Figure 4B:
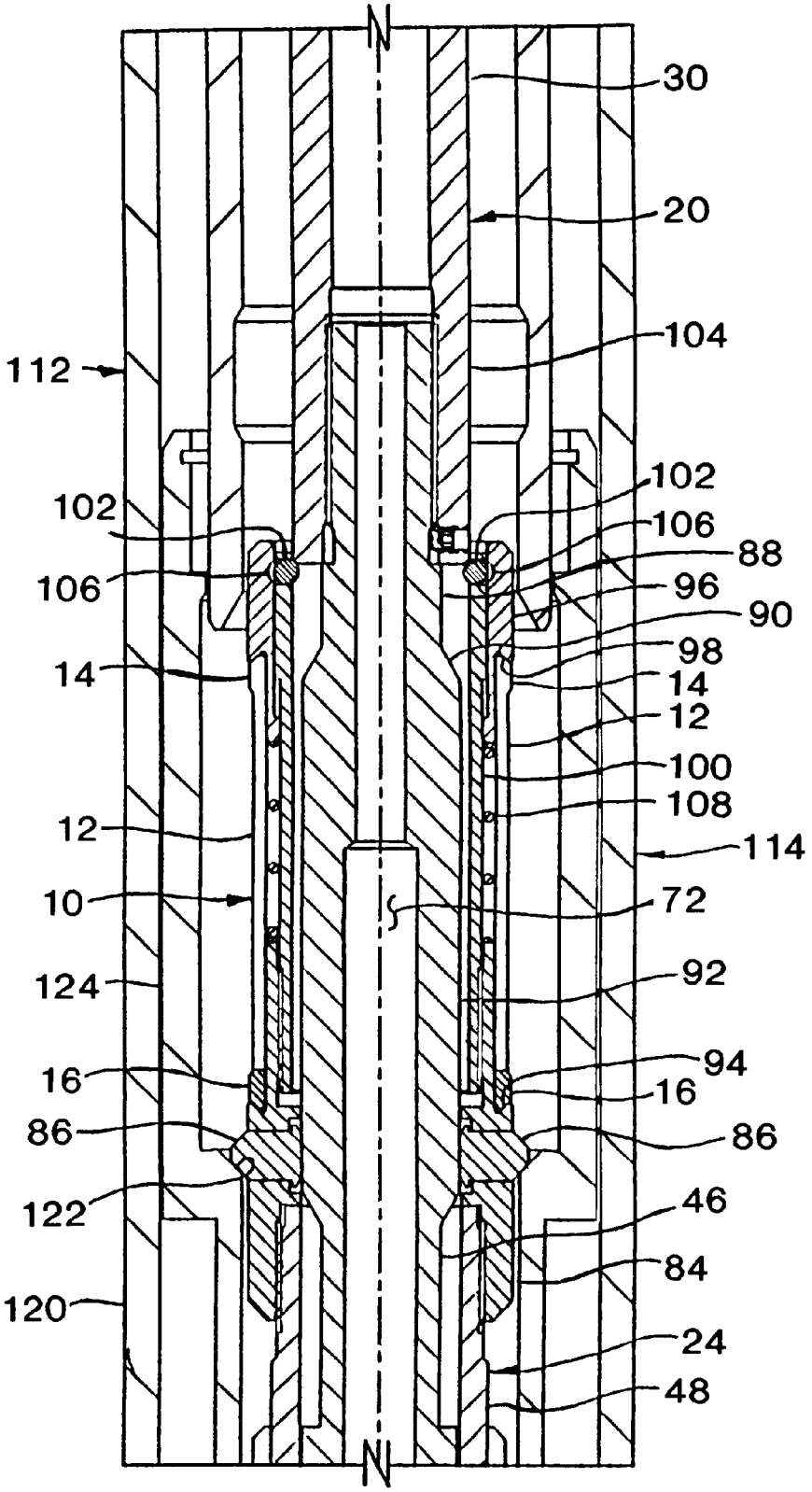
Figure 4C:
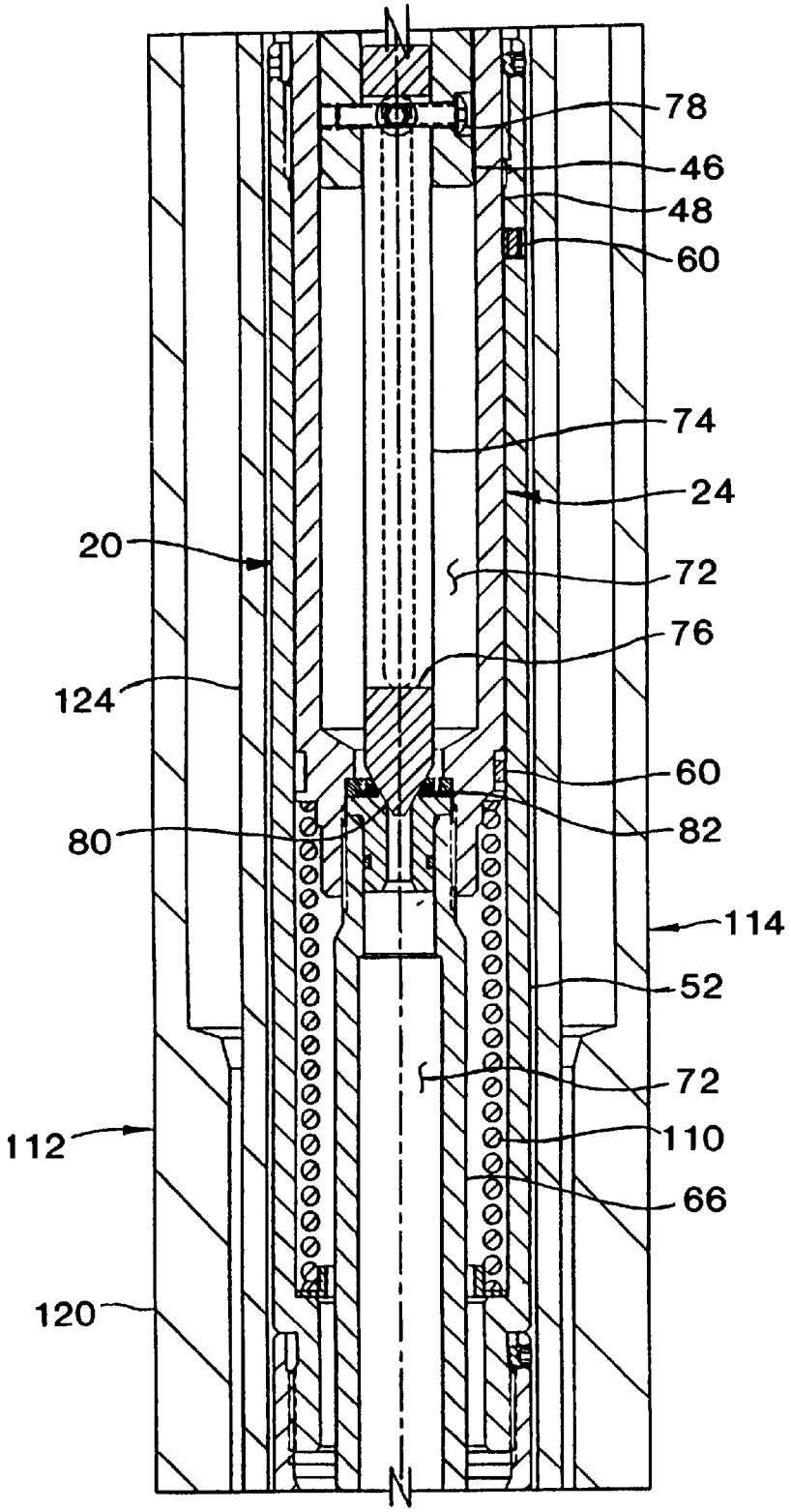
Figure 4D:
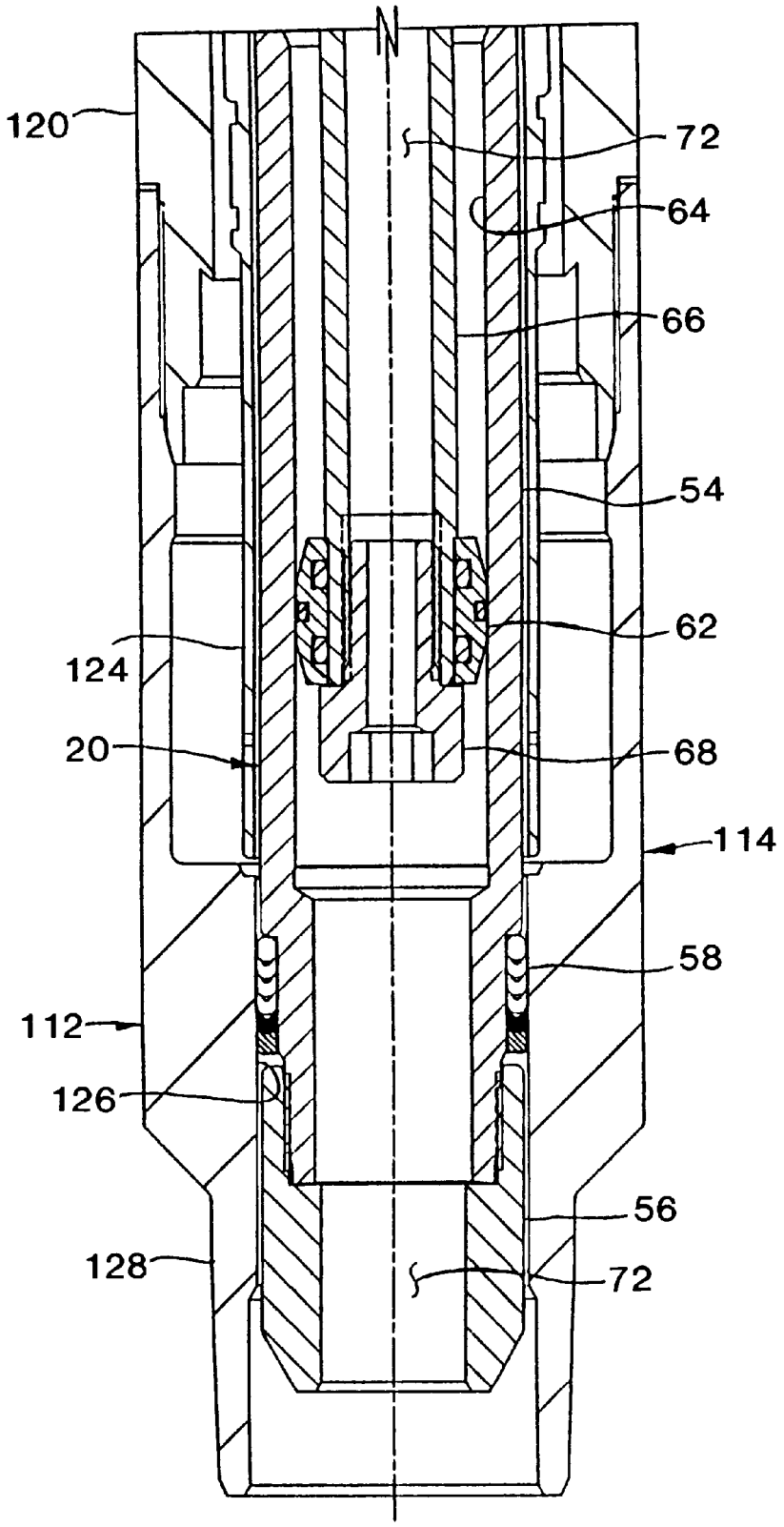
Figure 5A:
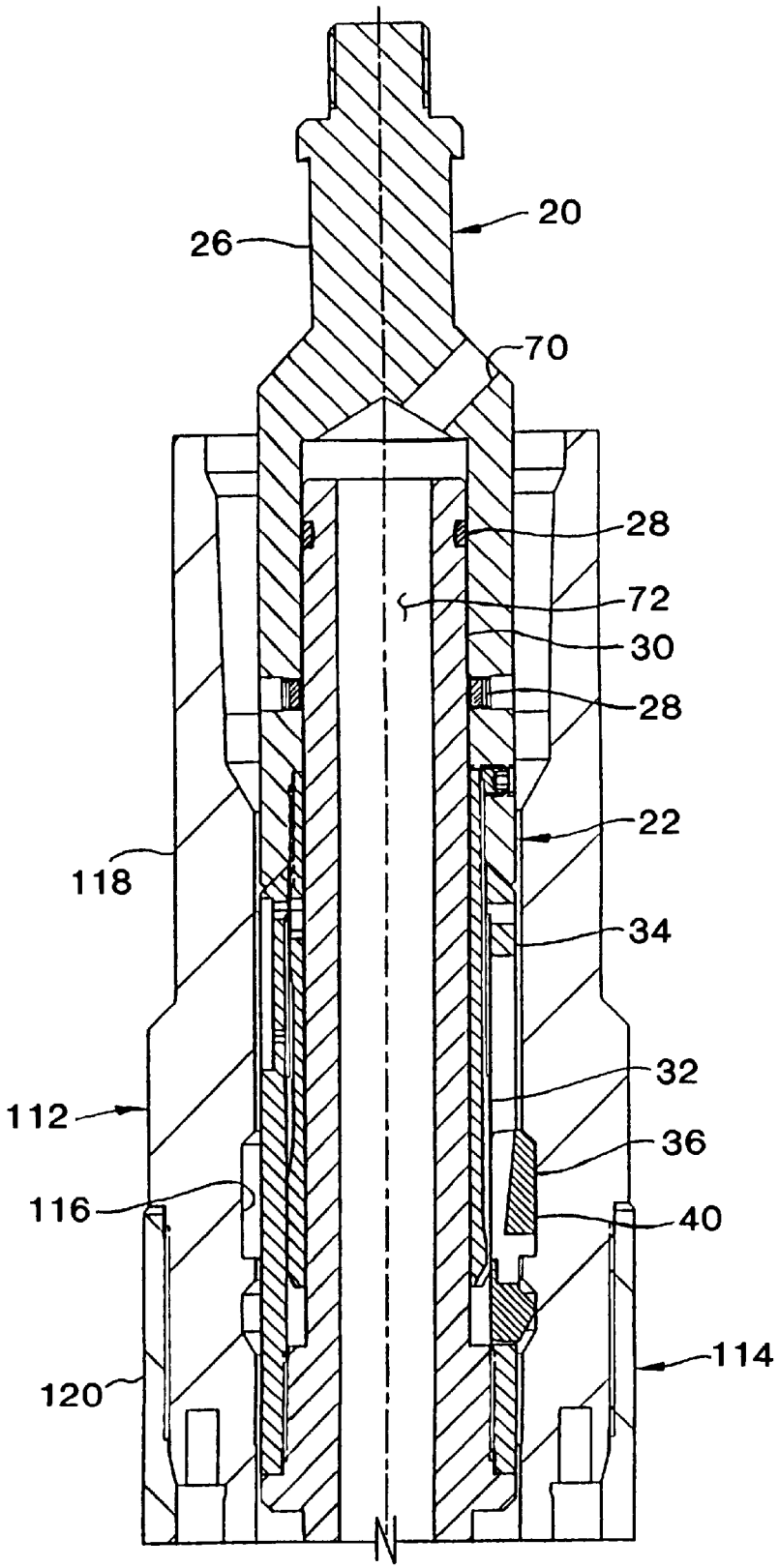
FIGS. 5A–5D are cross-sectional views of successive axial sections of the lock-out tool of FIGS. 2A–2D, the lock-out tool being shown in a configuration in which further fluid pressure has been applied to cause the lock-out tool to deposit the ring of FIG. 1 within the safety valve.
Figure 5B:
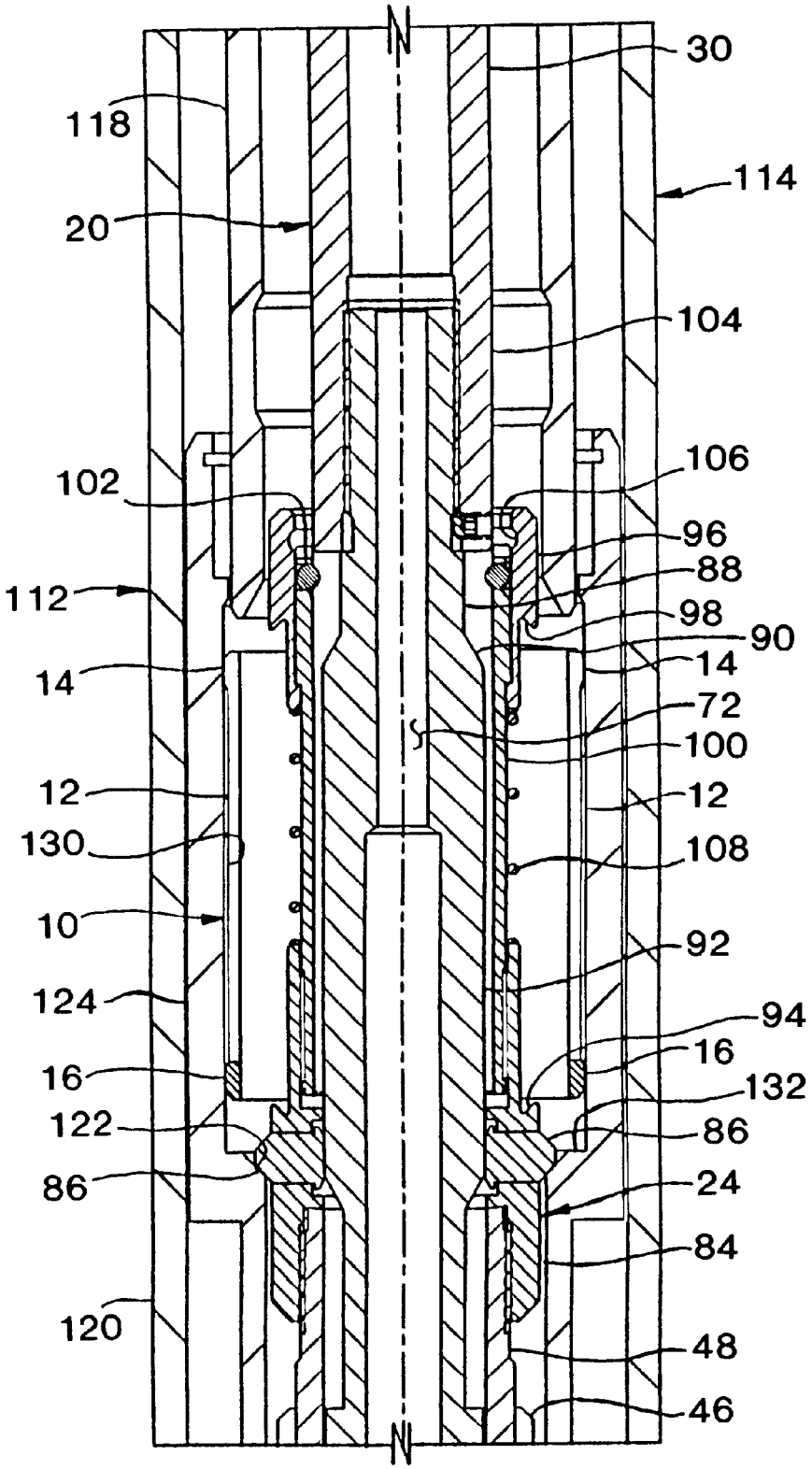
Figure 5C:
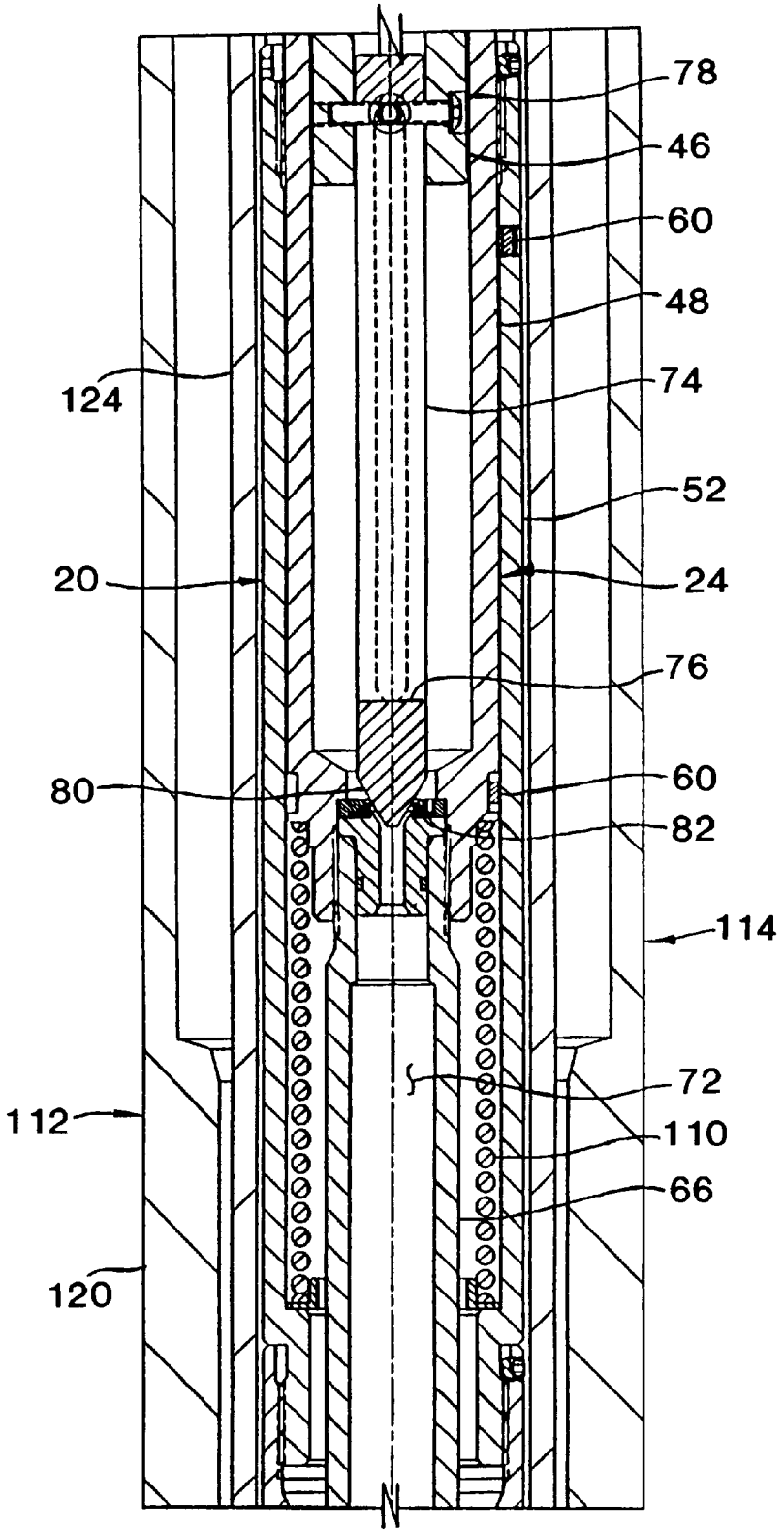
Figure 5D:
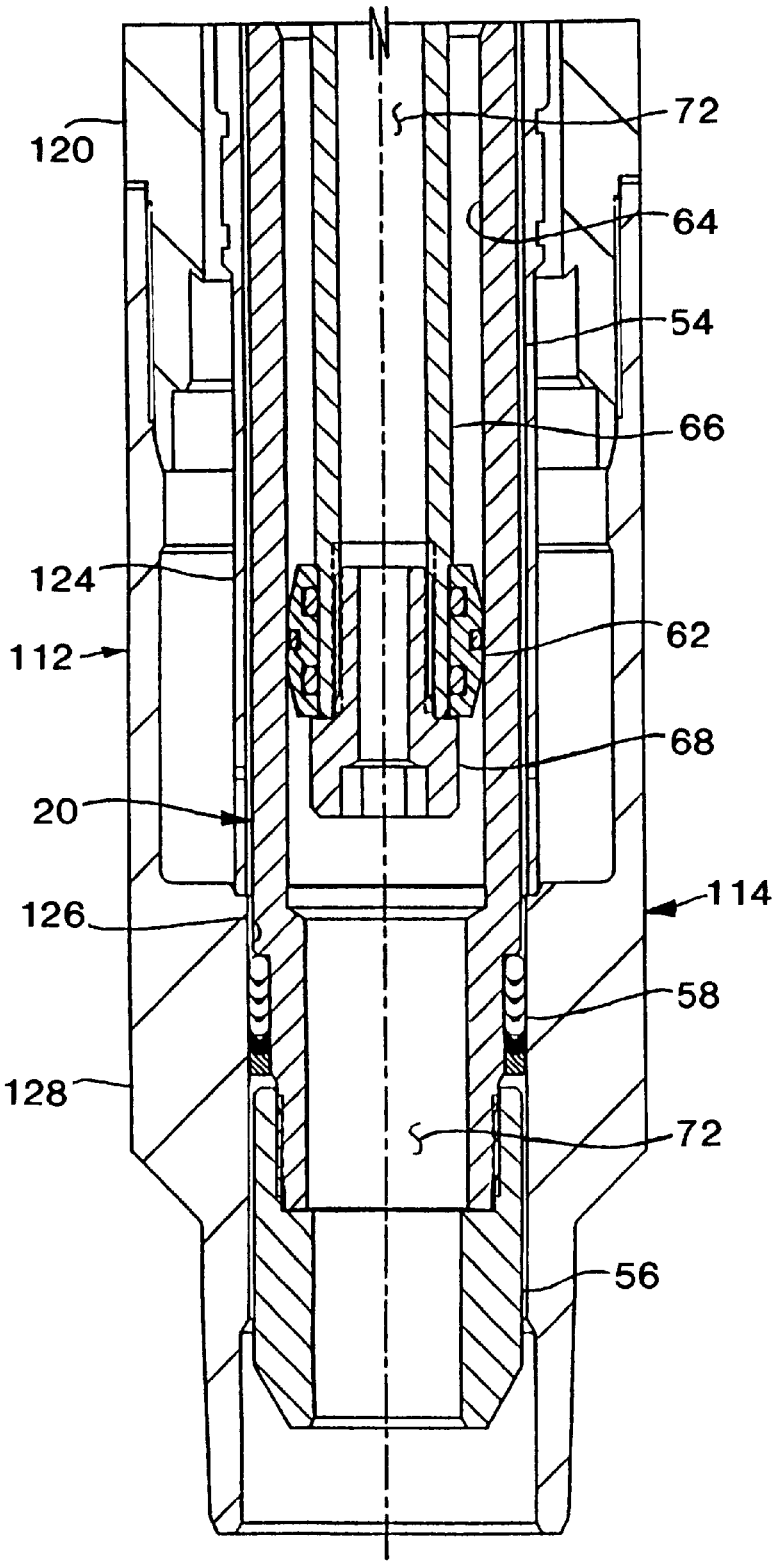

A generally conical nose 80 is formed on a lower end of the drop 74. As shown in FIG. 2C, the nose sealingly engages a seal 82 retained axially between shear sleeve 48 and the piston sleeve 66. Such sealing engagement between the nose 80 and seal 82 prevents fluid pressure in a portion of the fluid passage 72 above the seal from entering a lower portion of the fluid passage below the seal. Thus, with the tool 20 configured as shown in FIGS. 2A–2D, fluid pressure may be applied across the piston 62 by applying the fluid pressure to the upper portion of the fluid passage 72 with the drop 74 sealingly engaged with the seal 82.

Note that the seal 82 is rigidly secured relative to the displacement mechanism 24, but that the drop 74 is axially slidingly secured relative to the expander sleeve 46. It will be readily appreciated that, when the displacement mechanism 24 is downwardly displaced relative to the latch mechanism 22 as described more fully hereinbelow, the drop 74 will be permitted to displace downwardly therewith, but only to the extent that the engagement of the screw 78 in the slot 76 permits. Thus, if the seal 82 displaces further downwardly after the screw 78 has contacted an upper edge of the slot 76, the drop 74 will no longer sealingly engage the seal 82. It will be apparent to a person of ordinary skill in the art that, if the drop 74 no longer sealingly engages the seal 82, the fluid pressure will enter the lower portion of the fluid passage 72 and pass through the piston sleeve 66, piston 62, cap 68, etc., and a pressure differential across the piston can no longer be maintained.

The shear sleeve 48 is threadedly attached at its upper end to a dog retainer 84. A series of three dogs 86 extend radially slidingly through the dog retainer 84. As shown in FIG. 2B, the dogs 86 are radially retracted and contact a radially reduced portion 88 of the expander sleeve 46. During conveyance of the tool 20 into the safety valve, the dogs 86 are preferably radially retracted as shown in FIG. 2B. However, upon downward displacement of the displacement mechanism 24, the dogs 86 will be downwardly displaced relative to the expander sleeve 46, radially extended by an inclined face 90 formed on the expander sleeve 46, and maintained in their radially extended position by a radially enlarged portion 92 formed on the expander sleeve. In this manner, the dogs 86 radially outwardly engage an actuator member of the safety valve and permit the actuator member to be downwardly displaced along with the displacement mechanism 24.

The dog retainer 84 has a circumferential recess 94 formed thereon. The recess 94 is complementarily shaped relative to the end portions 18 of the segments 16. Thus, when the ring 10 is radially compressed, and the end portions 18 of the segments 16 are inserted into the recess 94 and axially maintained therein, the ring 10 is prevented from radially expanding relative to the dog retainer 84.

Similarly, a generally tubular ring retainer 96 has a circumferential recess 98 formed thereon which is complementarily shaped relative to the end portions 18 of the segments 14. When the ring 10 is radially compressed, and the end portions 18 of the segments 14 are inserted into the recess and axially maintained therein, the ring 10 is prevented from radially expanding relative to the ring retainer 96.

The ring 10 is maintained axially between the dog retainer 84 and the ring retainer 96 by means of a generally tubular retainer sleeve 100. The retainer sleeve 100 is threadedly attached to the dog retainer 84 and is axially slidingly disposed about the latch mandrel 30. One or more balls 102 (only one of which is visible in FIG. 2B) is radially slidingly received through the retainer sleeve 100. As shown in FIG. 2B, the ball 102 is radially retained between an outer side surface 104 of the latch mandrel 30 and a recess 106 internally formed on the ring retainer 96.

Engagement of the ball 102 in the recess 106 prevents axial displacement of the ring retainer 96 relative to the retainer sleeve 100. Thus, with the ball 102 engaged in the recess 106, the ring retainer 96 is not permitted to axially displace relative to the dog retainer 84, and the ring 10 is axially retained between the recesses 94, 98. However, when the displacement mechanism 24 has displaced downwardly a sufficient distance, the ball 102 will no longer be retained radially outward into engagement with the recess 106 by the surface 104 and the ring retainer 96 will be permitted to displace axially upward relative to the dog retainer 84, thereby releasing the ring 10 for radial expansion, as will be more fully described hereinbelow.

A spirally wound compression spring 108 applies an upwardly biasing force to the ring retainer 96. When the ball 102 is permitted to disengage from the recess 106, the spring 108 assists in axially upwardly displacing the ring retainer 96 to release the ring 10, and maintains the ring retainer in its axially upwardly displaced position relative to the retainer sleeve 100. It is to be understood that it is not necessary for the spring 108 to assist in radially upwardly displacing the ring retainer 96 in the tool 20, but the applicant prefers its use so that the ring retainer will remain in its axially upwardly displaced position upon retrieval of the tool to the earth's surface. In this manner, an operator at the earth's surface may verify proper operation of the tool 20, that is, that the displacement mechanism 24 displaced sufficiently to permit the ball 102 to be released from the recess 106. In a method of using the tool 20 described more fully hereinbelow, sufficient displacement of the displacement mechanism 24 ensures that the actuator member of the safety valve has displaced sufficiently to open the safety valve.

Note that another spirally wound compression spring 110 is included in the tool 20. The spring 110 is retained radially between the piston sleeve 66 and the spring housing 52, and axially between an internal shoulder of the spring housing and an external shoulder of the shear sleeve 48. The spring 10 exerts an upwardly biasing force on the displacement mechanism 24, so that, if the displacement mechanism malfunctions, or the tool 20 must be retrieved before the displacement mechanism has been sufficiently downwardly displaced to release the ring 10, the spring 110 will act to prevent further downward displacement of the displacement mechanism and reset the tool back to its original configuration wherein the dogs 86 are permitted to radially retract. In this manner, the tool 20 may be retrieved without danger of the ring 10 being deposited inadvertently.

Referring additionally now to FIGS. 3A–3D, the lock-out tool 20 is representatively illustrated received within a subterranean safety valve 112 interconnected as a portion of a tubing string 114 extending to the earth's surface. Such safety valves, which are designed for interconnection in tubing strings, are commonly referred to as tubing retrievable safety valves. The safety valve 112 is schematically representative of the WELLSTAR® safety valve referred to above, and which is more fully described on page 4–5 of a Halliburton Completion Products catalog no. CPP5653 and a sales brochure no. H00105, the disclosures of which are hereby incorporated by this reference. It is to be clearly understood, however, that a lock-out tool constructed in accordance with the principles of the present invention may be utilized with other safety valves, and with other types of safety valves, such as wireline retrievable safety valves, etc.

Additionally, it is to be clearly understood that a tool constructed in accordance with the principles of the present invention may be utilized to deposit a radially displaceable ring with respect to other downhole tools. The tool may deposit the ring within, or external to, the other downhole tools, and the tool may facilitate radial expansion or contraction of the ring upon its deposition.

As shown in FIGS. 3A–3D, the tool 20 has been partially actuated. The keys 36 of the latch mechanism 22 have radially outwardly engaged an internal profile 116 formed in an upper sub 118 of the safety valve 112. The upper sub 118 is threadedly attached to an outer housing 120 of the safety valve 112. Thus, the latch mechanism 22 is prevented from displacing further axially downward relative to the safety valve 112. Note that it is not necessary for the latch mechanism 22 to engage an internal profile formed directly on the safety valve 112, for example, the internal profile 116 could instead be formed internally on a nipple (not shown) interconnected in the tubing string 114 above the safety valve.

A downwardly directed force has been applied to the upper head 26, for example, by jarring downwardly thereon. The shear screw 28 has been sheared, permitting the upper head and key support 32 to displace axially downward relative to the remainder of the latch mechanism 22. Such downward displacement of the key support 32 radially outwardly supports the keys 36 in engagement with the profile 116 and releasably prevents radially inward retraction of the keys. Thus, the latch mechanism is releasably secured relative to the safety valve 112 as shown in FIGS. 3A–3D. Note that the springs 38 are not shown in FIG. 3A for illustrative clarity.

The seal 58 is sealingly engaged within a seal bore 126 formed internally on a lower sub 128 of the safety valve 112. The lower sub 128 is threadedly attached to the outer housing 120 of the safety valve 112. Note that it is not necessary for the seal bore 126 to be formed directly on the safety valve 112, it may instead be formed, for example, internally on another component of the tubing string 114 below the safety valve.

As shown in FIGS. 3A–3D, a portion of a sequence of increasing fluid pressure has been applied to the tubing string 114 above the safety valve 112. This sequence of increasing fluid pressure may be applied in a continuous manner, however, for clarity of description of the operation of the tool 20, specific portions of the sequence will be separately described along with the corresponding alterations in the configuration of the tool 20 and safety valve 112. It is to be clearly understood that the portions of the sequence of increasing fluid pressure may or not be interrupted, may or not be applied in the specific order described herein, and may or may not be continuous without departing from the principles of the present invention.

The fluid pressure applied to the tool 20 as shown in FIGS. 3A–3D has entered the port 70 and the upper portion of the fluid passage 72. However, with the drop 74 sealingly engaging the seal 82, the fluid pressure is not permitted to enter the fluid passage 72 below the seal. Thus, a pressure differential is created across the piston 62, causing a downwardly directed force to be applied to the displacement mechanism 24. As a result, the shear screw 60 has sheared, thereby permitting the displacement mechanism 24 to displace somewhat axially downward.

Such axially downward displacement of the displacement mechanism 24 has displaced the dogs 86 downward relative to the expander sleeve 46, thereby causing the dogs to radially outwardly extend relative to the dog retainer 84. The dogs 86 now engage and axially contact an inclined face 122 formed internally on an actuator member 124 of the safety valve 112. In the schematically represented safety valve 112, the actuator member 124 is an opening prong, which is axially displaced to open a flapper (not shown) of the valve in normal operation of the safety valve.

It is to be understood, however, that where a lock-out tool constructed in accordance with the principles of the present invention is utilized in another safety valve, another type of safety valve, or another type of valve, the actuator member may be other than an opening prong without departing from the principles of the present invention. For example, where the tool 20 is utilized to lock-out a ball valve (in either a closed or open position), the actuator member 124 may instead be a piston, sleeve, arms, etc. associated with causing rotation of a ball. Thus, although the lock-out tool 20 as described herein is utilized to prevent closure of a certain type of tubing retrievable safety valve, a tool constructed in accordance with the principles of the present invention may be utilized to prevent opening or closure of another type of valve, or perform another operation.

Referring additionally now to FIGS. 4A–4D, a further portion of the sequence of increasing fluid pressure has been applied to the tubing string 114 above the safety valve 112. This increase in fluid pressure has caused the displacement mechanism 24 to further downwardly displace, thereby displacing the actuator member 124 downwardly therewith. This downward displacement of the actuator member 124 has opened the safety valve 112, similar to the valve having been opened in a normal manner by applying fluid pressure to a control line attached to the valve.

Of course, it will be readily apparent to one of ordinary skill in the art that when the tool 20 was initially inserted into the valve 112 the nose 56 would have deflected the flapper (not shown) out of sealing engagement with its seat (not shown). However, the applicant prefers that the actuator member 124 be downwardly displaced to maintain the valve 112 in its open configuration after the ring 10 is deposited therein, as more fully described hereinbelow.

Note that the dogs 86 remain radially outwardly engaged with the actuator member 124. The actuator member 124 is, thus, maintained in its downwardly displaced position during deposition of the ring 10.

Note, also, that the balls 102 are about to be completely released from the recess 106 of the ring retainer 96. This is due to the fact that the displacement mechanism 24 has downwardly displaced relative to the latch mandrel 30. When the balls 102 are permitted to radially inwardly retract completely out of engagement with the recess 106, the balls no longer being radially outwardly supported by the surface 104, the ring retainer 96 will be permitted to upwardly displace relative to the retainer sleeve 100 and the ring 10 will be released from the tool 20.

At this point, the drop 74 remains in sealing engagement with the seal 82. Note, however, that the screw 78 is disposed very near the top of the slot 76. Further downward displacement of the displacement mechanism 24 will cause the seal 82 to displace downward relative to the drop 74, thereby relieving any pressure differential across the piston 62.

Referring additionally now to FIGS. 5A–5D, a further portion of the sequence of increasing fluid pressure has been applied to the tubing string 114 above the safety valve 112. The displacement mechanism 24 has now displaced the actuator member 124 fully downwardly, such that it now axially contacts the lower sub 128. Such downward displacement of the displacement mechanism 24 has also caused the seal 82 to disengage from the drop 74. This, in turn, causes the pressure differential across the piston 62 to be relieved, at least partially reducing the fluid pressure in the tubing string 114 above the safety valve 112, thereby giving an indication at the earth's surface that the displacement mechanism 24 has fully downwardly displaced.

The balls 102 are now fully inwardly retracted out of engagement with the recess 106. The ring retainer 96 has axially upwardly displaced relative to the retainer sleeve 100, thereby permitting the ring 10 to radially outwardly extend into an annular recess 130 axially between an internal shoulder 132 formed on the actuator member 124 and a lower end of the upper sub 118.

The recess 130 was axially elongated by the downward displacement of the actuator member 124 relative to the upper sub 118 and, in order to close the safety valve 112, the recess would have to be radially compressed. The presence of the ring 10 within the recess 130 restricts axially upward displacement of the actuator member relative to the upper sub 118 and thereby prevents closure of the safety valve 112. It is to be clearly understood, however, that the ring 10 may be otherwise deposited within the safety valve 112 to prevent its closure without departing from the principles of the present invention.

Referring additionally now to FIGS. 6A–6D, an axially upwardly directed force has been applied to the upper head 26 to release the latch mechanism 22 from the upper sub 118. Note that the keys 36 are permitted to radially inwardly retract out of engagement with the profile 116, the key support 30 no longer radially outwardly supporting the keys. The tool 20 is now in a configuration in which it may be retrieved to the earth's surface through the tubing string 114.

Figure 6A:
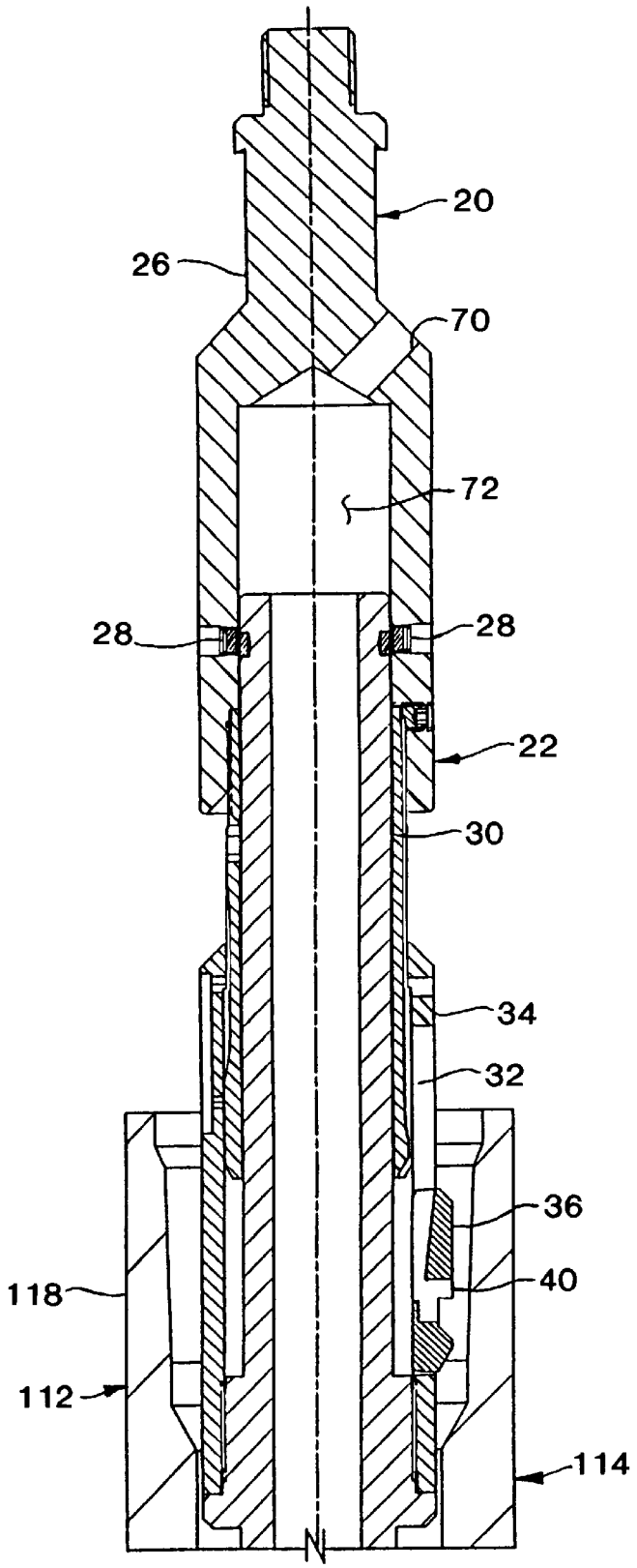
FIGS. 6A–6D are cross-sectional views of successive axial sections of the lock-out tool of FIGS. 2A–2D, the lock-out tool being shown in a configuration in which it is being retrieved from within the safety valve.
Figure 6B:
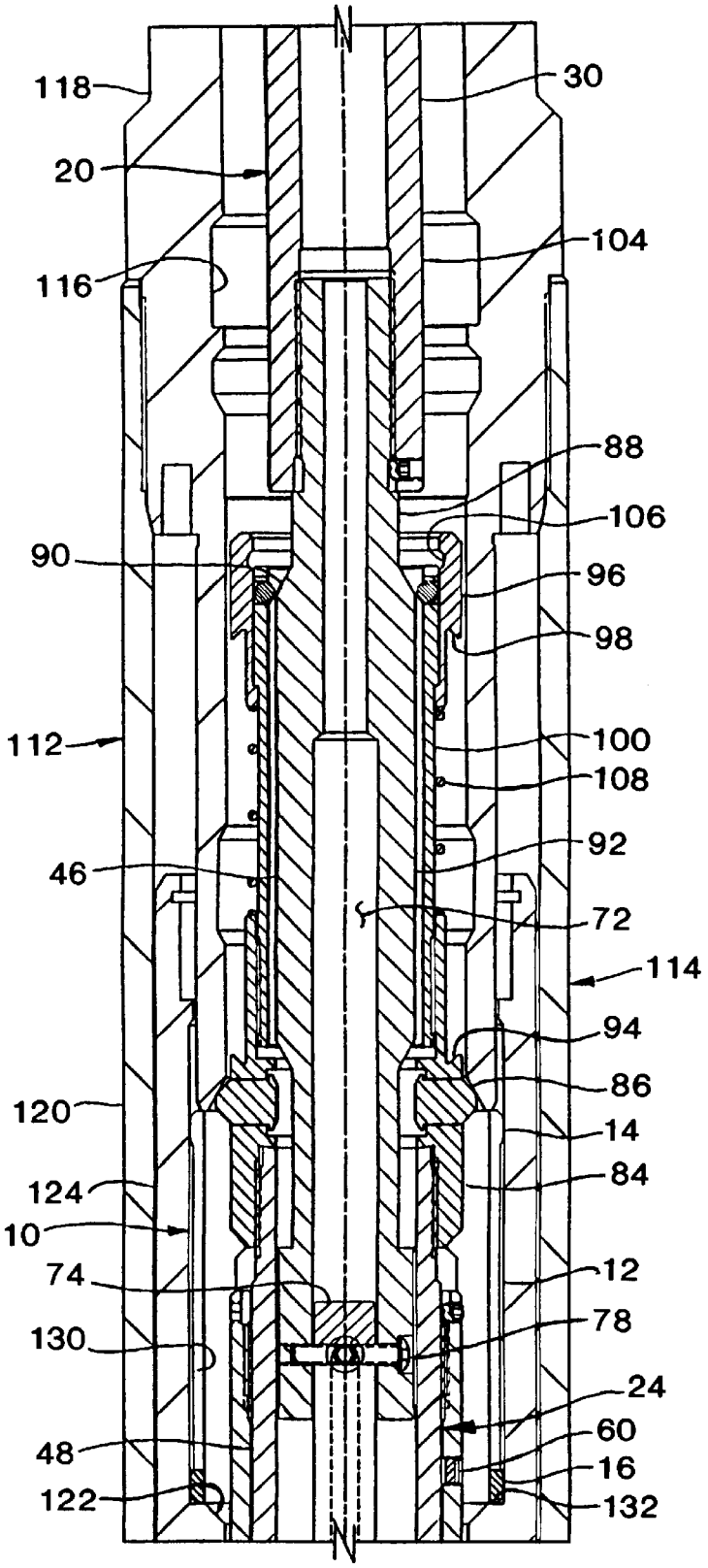

The ring 10 remains in the recess 130 as the tool 20 is displaced axially upwardly out of the safety valve 112. As shown in FIG. 6B, the actuator member 124 has displaced axially upward somewhat relative to the outer housing 120, for example, due to the upwardly directed biasing force exerted on the actuator member by a spring (not shown) of the safety valve 112. However, such axially upward displacement of the actuator member 124 is limited by the ring 10, which is capable of withstanding this force. Thus, even though the actuator member 124 may axially upwardly displace somewhat, it cannot upwardly displace sufficiently far to permit closure of the safety valve 112.

Note that the dogs 86 no longer contact the inclined face 122, but now contact the lower end of the upper sub 118. Such will not prevent withdrawal of the tool 20 from the safety valve 122, however, because the dogs 86 are no longer radially outwardly supported by the radially enlarged portion 92 of the expander sleeve 46 and may radially inwardly retract.

When retrieved to the earth's surface, the ring retainer 96 will be in its axially upwardly displaced position as shown in FIG. 6B, due to the upwardly biasing force of the spring 108. An operator may thus verify that the ring 10 was properly released by the axial displacement of the ring retainer 96 relative to the retainer sleeve 100.

Figure 6C:
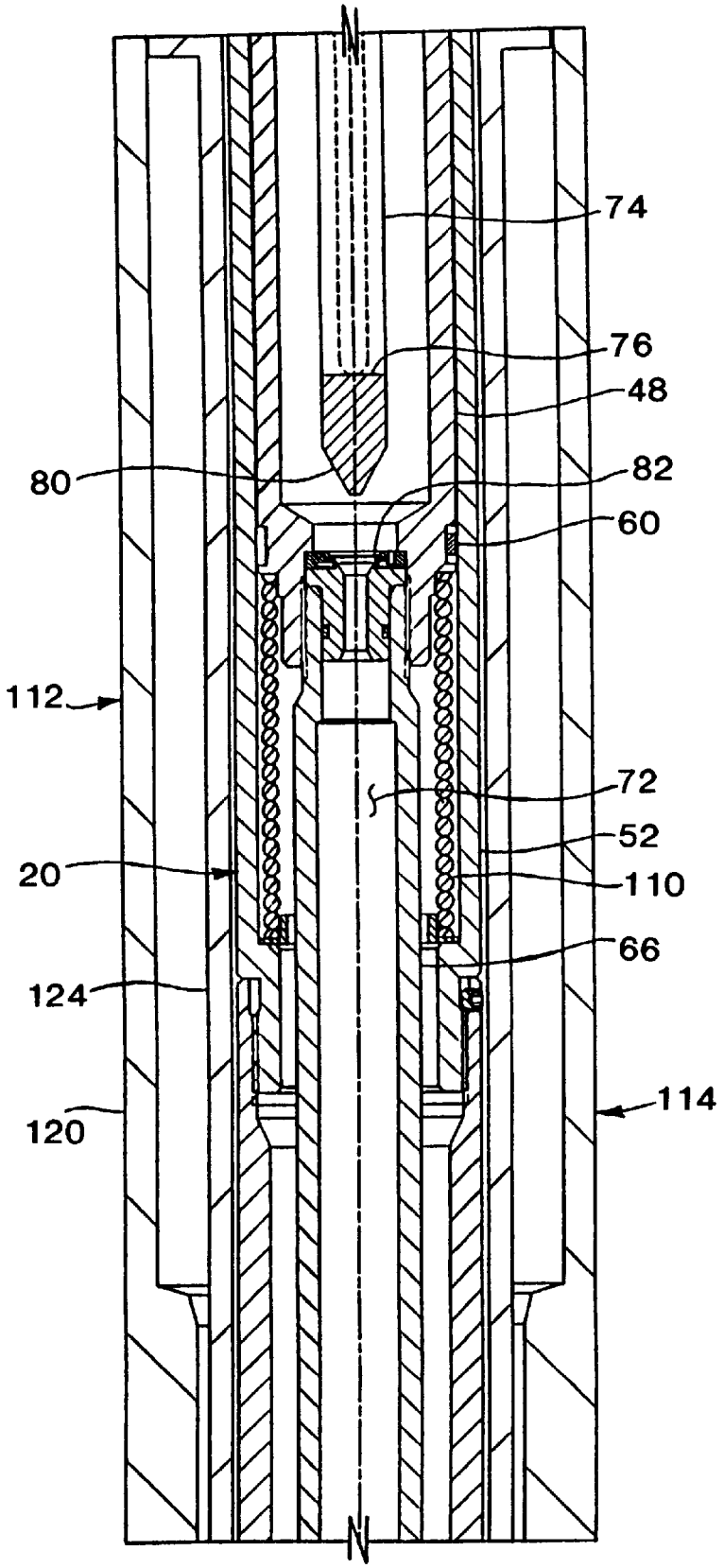
Figure 6D:
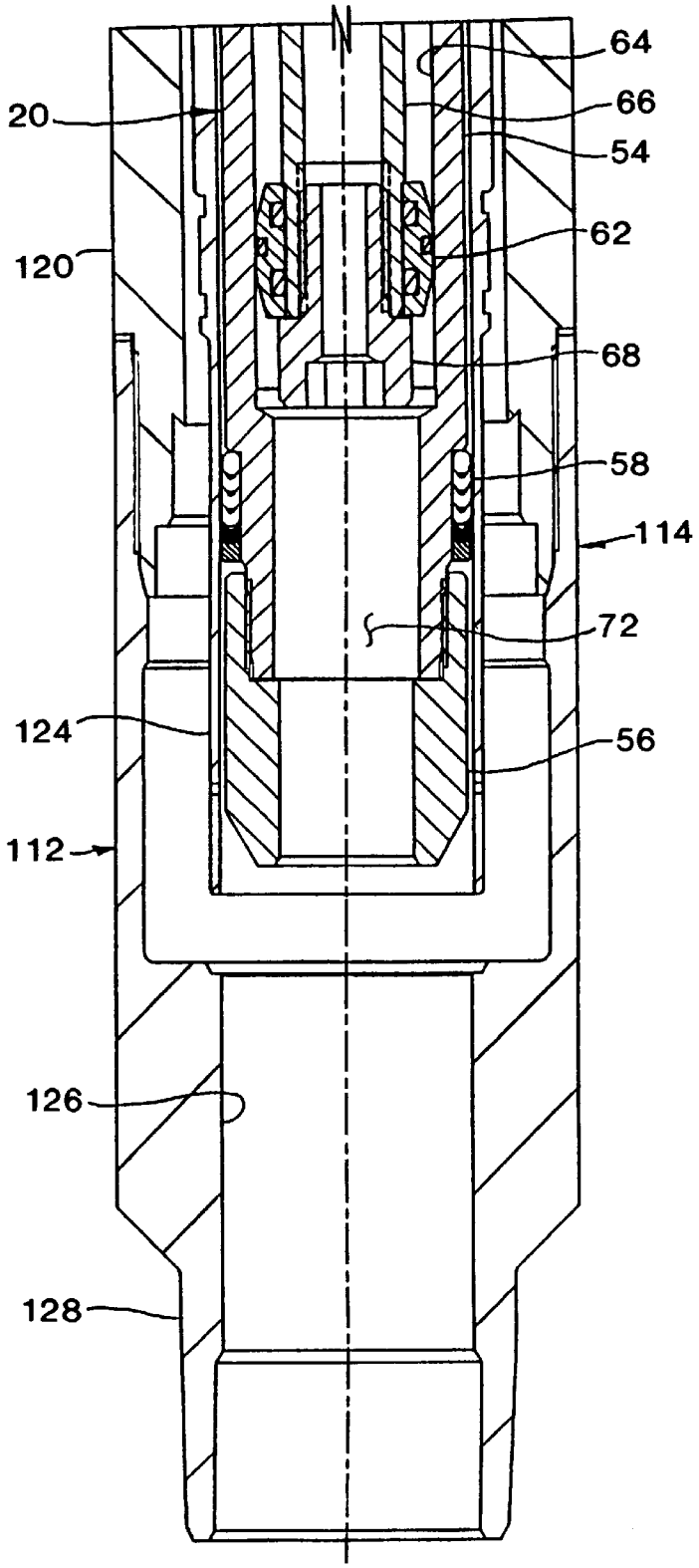

As shown in FIG. 6C, the spring 110 is axially compressed. As described above, the spring 110 exerts an upwardly biasing force on the displacement mechanism 24. Thus, the spring 110 may cause the displacement mechanism 24 to axially upwardly displace relative to the latch mechanism 22 after deposition of the ring 10 and/or during retrieval of the tool 20.

Thus has been described the tool 20 which is capable of utilizing the ring 10 instead of a thin or weak expandable ring, and which is releasably secured relative to an outer housing of a safety valve instead of being located relative to a moveable point of reference during its operation. The tool 20 conveniently prevents closure of a safety valve by depositing the ring 10 within the valve.

Of course, modifications, additions, deletions, substitutions, and other changes may be made to the tool 20 and ring 10 utilized therewith, which changes would be obvious to a person of ordinary skill in the art. For example, the tool 20 may be modified to permit its use in a primary lock-out operation, to permit its use in preventing opening or closure of another type of valve or other equipment, to deposit an expandable ring in another type of operation etc. Accordingly, the foregoing detailed description is to be clearly understood as being given by way of illustration and example only, the spirit and scope of the present invention being limited solely by the appended claims.

What is claimed is:

1. A radially deflectable ring operatively positionable relative to first and second members of a downhole tool to limit displacement of the first member relative to the second member, the ring comprising:

a series of generally circumferentially spaced apart and generally axially extending cantilevers, the cantilevers being insertable axially between a portion of the first member and a portion of the second member, each of the cantilevers having first and second opposite ends, each of the first opposite ends being attached to another of the first opposite ends, and each of the second opposite ends being attached to another of the second opposite ends.

2. The ring according to claim 1, further comprising first and second series of generally circumferentially spaced apart segments, the first segments being axially spaced apart from the second segments, and wherein each of the cantilever first opposite ends is attached to a corresponding one of the first segments, and each of the cantilever second opposite ends is attached to a corresponding one of the second segments.

3. The ring according to claim 2, wherein at least one of the first and second series of segments is generally annular-shaped.

4. The ring according to claim 1, wherein each of the cantilevers is attached to two other ones of the cantilevers, the series of cantilevers thereby forming the ring in a generally circumferentially continuous manner.

5. The ring according to claim 1, wherein the first opposite ends are attached to each other via a first series of generally circumferentially spaced apart segments.

6. The ring according to claim 5, wherein the second opposite ends are attached to each other via a second series of generally circumferentially spaced apart segments.

7. A method of locking-out a safety valve operatively positioned within a subterranean wellbore, the method comprising the steps of:

locking a tool within the safety valve in a fixed position relative to an outer housing of the safety valve; and operating the tool to deposit a radially expandable ring within the safety valve and thereby restrict displacement of an actuator member of the safety valve.

8. The method according to claim 7, wherein the step of locking further comprises latching the tool to an internal profile attached to the outer housing.

9. The method according to claim 8, wherein the step of locking further comprises radially outwardly extending a latch member into engagement with the internal profile.

10. The method according to claim 9, wherein the step of locking further comprises releasably securing the latch member in its engagement with the internal profile.

11. The method according to claim 7, wherein the step of operating the tool further comprises displacing the actuator member from a position in which the safety valve is closed to a position in which the safety valve is open.

12. The method according to claim 11, wherein the displacing step is performed by engaging a portion of the tool with the actuator member, and displacing the tool portion relative to the outer housing.

13. The method according to claim 11, wherein the displacing step is performed by applying fluid pressure to the tool, and wherein the tool is free of sealing engagement with the actuator member.

14. The method according to claim 7, wherein in the operating step, the ring is deposited in an annular recess axially between a portion of the actuator member and an internal shoulder of the safety valve.

15. The method according to claim 7, wherein the operating step is performed by applying a sequence of increasing fluid pressure to the tool.

16. The method according to claim 15, wherein a first portion of the sequence causes the tool to engage the actuator member.

17. The method according to claim 16, wherein a second portion of the sequence causes the tool to displace the actuator member.

18. For use in locking-out a safety valve having an actuator member operatively displaceable relative to an internal profile attached to an outer housing of the safety valve, apparatus comprising:

a latch mechanism capable of engaging the internal profile and securing the latch mechanism in a fixed position relative to the outer housing;

a displacement mechanism attached to the latch mechanism, the displacement mechanism being capable of engaging the actuator member and displacing the actuator member relative to the latch mechanism to a first position in which the safety valve is open; and a blocking member carried relative to the displacement mechanism, the blocking member being deposited non-destructively within the safety valve and restricting displacement of the actuator member when the actuator member is displaced to the first position by the displacement mechanism.

19. The apparatus according to claim 18, wherein the safety valve further has a seal bore, the actuator member being axially slidably disposed between the internal profile and the seal bore, and wherein the displacement mechanism includes a seal capable of sealingly engaging the seal bore when the latch mechanism engages the internal profile.

20. The apparatus according to claim 19, wherein the seal is attached to the latch mechanism, such that the seal is secured in its position relative to the outer housing when the actuator member is displaced by the displacement mechanism.

21. The apparatus according to claim 18, wherein the displacement mechanism includes at least one radially outwardly extendable engagement member capable of engaging the actuator member.

22. The apparatus according to claim 21, wherein the displacement mechanism is configured to displace the engagement member relative to the latch mechanism in order to displace the actuator member to the first position.

23. The apparatus according to claim 22, wherein the displacement mechanism further includes a piston attached to the engagement member, the piston being capable of displacing relative to the latch mechanism in response to fluid pressure applied to the piston.

24. The apparatus according to claim 23, further comprising a pressure relief device, the pressure relief device being configured to relieve the fluid pressure applied to the piston after the blocking member is deposited within the safety valve.

25. The apparatus according to claim 18, wherein the blocking member is a generally circumferentially continuous ring.

26. The apparatus according to claim 25, wherein the ring includes a series of interconnected generally axially extending cantilevers.

27. The apparatus according to claim 18, wherein the blocking member is radially inwardly retained by a first retainer secured to the displacement mechanism and by a second retainer axially slidingly disposed relative to the displacement mechanism.

28. The apparatus according to claim 27, wherein the second retainer is releasably secured to the displacement mechanism, the second retainer being released for sliding displacement relative to the displacement mechanism when the displacement mechanism is displaced a predetermined distance relative to the latch mechanism.

29. Apparatus for locking-out a safety valve operatively positioned within a subterranean wellbore, the apparatus comprising:

a radially deflectable ring including a series of generally circumferentially spaced apart and generally axially extending cantilevers, each of the cantilevers having first and second opposite ends, each of the first opposite ends being attached to another of the first opposite ends, and each of the second opposite ends being attached to another of the second opposite ends.

30. The apparatus according to claim 29, further comprising first and second series of generally circumferentially spaced apart segments, the first segments being axially spaced apart from the second segments, and wherein each of the cantilever first opposite ends is attached to a corresponding one of the first segments, and each of the cantilever second opposite ends is attached to a corresponding one of the second segments.

31. The apparatus according to claim 30, wherein at least one of the first and second series of segments is generally annular-shaped.

32. The apparatus according to claim 29, wherein each of the cantilevers is attached to two other ones of the cantilevers, the series of cantilevers thereby forming the ring in a generally circumferentially continuous manner.

33. The apparatus according to claim 29, wherein the first opposite ends are attached to each other via a first series of generally circumferentially spaced apart segments.

34. The apparatus according to claim 33, wherein the second opposite ends are attached to each other via a second series of generally circumferentially spaced apart segments.

35. A method of locking-out a safety valve operatively positioned within a subterranean wellbore, the method comprising the steps of:

sealingly engaging a lock-out tool with a seal bore of the safety valve, the seal bore being attached to an outer housing of the safety valve;

securing the lock-out tool axially within the safety valve relative to the outer housing;

applying fluid pressure to the lock-out tool to thereby cause a portion of the lock-out tool to engage an actuator member of the safety valve and displace the actuator member relative to the outer housing; and to axially elongate an annular recess within the safety valve; and depositing a blocking member within the annular recess to thereby restrict displacement of the actuator member relative to the outer housing, the blocking member being a ring having a generally circumferentially continuous construction, the ring having a series of interconnected generally axially extending cantilevers, the cantilevers being laterally deflectable to thereby permit radial compression of the ring.

36. The method according to claim 35, wherein the fluid pressure applying step further comprises opening the safety valve by such displacement of the actuator member.

37. The method according to claim 35, wherein in the securing step, the lock-out tool is secured to an internal profile of the safety valve, the actuator member being disposed axially between the seal bore and the internal profile.

38. A method of limiting displacement of a first member of a tool operatively positioned within a subterranean wellbore, the method comprising the steps of:

locking an apparatus within the tool in a fixed position relative to a second member of the tool; and operating the apparatus to deposit a circumferentially continuous, radially expandable blocking member relative to the tool and thereby restrict displacement of the first member.

39. The method according to claim 38, wherein the step of locking further comprises latching the apparatus to an internal profile formed on the second member.

40. The method according to claim 39, wherein the step of locking further comprises radially outwardly extending a latch member into engagement with the internal profile.

41. The method according to claim 40, wherein in the step of locking further comprises releasably securing the latch member in its emgagement with the internal profile.

42. The method according to claim 38, wherein the step of operating the apparatus further comprises displacing the first member from a first position to a second position to thereby operate the tool.

43. The method according to claim 42, wherein the displacing step is performed by engaging a portion of the apparatus with the first member, and displacing the apparatus portion relative to the second member.

44. The method according to claim 42, wherein the displacing step is performed by applying fluid pressure to the apparatus, and wherein the apparatus is free of sealing engagement with the first member.

45. The method according to claim 38, wherein in the operating step, the blocking member is deposited in an annular recess within the tool.

46. The method according to claim 38, wherein the operating step is performed by applying a sequence of increasing fluid pressure to the apparatus.

47. The method according to claim 46, wherein a first portion of the sequence causes the apparatus to engage the first member.

48. The method according to claim 47, wherein a second portion of the sequence causes the apparatus to displace the first member.

49. Apparatus for limiting movement of a member of a tool operatively positioned within a subterranean wellbore, the apparatus comprising:

a radially deflectable ring including a series of generally circumferentially spaced apart and generally axially extending cantilevers, the ring being releasably retained relative to the remainder of the apparatus, whereby the apparatus is capable of depositing the ring relative to the tool.

50. The apparatus according to claim 49, wherein the ring further includes first and second series of generally circumferentially spaced apart segments, the first segments being axially spaced apart from the second segments, and wherein each of the cantilevers has opposite ends, one of each of the cantilever opposite ends being attached to a corresponding one of the first segments, and the other of each of the cantilever opposite ends being attached to a corresponding one of the second segments.

51. The method according to claim 50, wherein each of the first segments is attached to two of the one of the cantilever opposite ends, and wherein each of the second segments is attached to two of the other of the cantilever oppposite ends.

52. The apparatus according to claim 50, wherein at least one of the first and second series of segments is generally annular-shaped.

53. The apparatus according to claim 49, wherein each of the cantilevers is attached to two other ones of the cantilevers, the series of cantilevers thereby forming the ring in a generally circumferentially continuous manner.

54. A The apparatus according to claim 49, wherein each of the cantilevers has first and second opposite ends, each of the first opposite ends being attached to another of the first opposite ends, and each of the second opposite ends being attached to another of the second opposite ends.

55. The apparatus according to claim 54, wherein the first opposite ends are attached to each other via a first series of generally circumferentially spaced apart segments.

56. The apparatus according to claim 55, wherein the second opposite ends are attached to each other via a second series of generally circumferentially spaced apart segments.

57. For use in limiting displacement of a first member operatively displaceable relative to a second member of a tool, apparatus comprising:

a latch mechanism capable of engaging a profile secured relative to the second member, and thereby securing the latch mechanism in a fixed position relative to the second member;

a displacement mechanism attached to the latch mechanism, the displacement mechanism being capable of engaging the first member and displacing the first member relative to the latch mechanism; and an expandable blocking member carried relative to the displacement mechanism, the expandable blocking member being deposited relative to the tool and limiting displacement of the first member when the first member is displaced by the displacement mechanism.

58. The apparatus according to claim 57, wherein the tool further has a seal bore, the first member being axially slidably disposed between the profile and the seal bore, and wherein the displacement mechanism includes a seal capable of sealingly engaging the seal bore when the latch mechanism engages the profile.

59. The apparatus according to claim 58, wherein the seal is attached to the latch mechanism, such that the seal is secured in its position relative to the second member when the first member is displaced by the displacement mechanism.

60. The apparatus according to claim 57, wherein the displacement mechanism includes at least one radially displaceable engagement member capable of engaging the first member.

61. The apparatus according to claim 60, wherein the displacement mechanism is configured to displace the engagement member relative to the latch mechanism in order to displace the first member relative to the second member.

62. The apparatus according to claim 61, wherein the displacement mechanism further includes a piston attached to the engagement member, the piston being capable of displacing relative to the latch mechanism in response to fluid pressure applied to the piston.

63. The apparatus according to claim 62, further comprising a pressure relief device, the pressure relief device being configured to relieve the fluid pressure applied to the piston after the blocking member is deposited relative to the tool.

64. The apparatus according to claim 57, wherein the blocking member is a generally circumferentially continuous ring.

65. The apparatus according to claim 64, wherein the ring includes a series of interconnected generally axially extending cantilevers.

66. The apparatus according to claim 57, wherein the blocking member is radially inwardly retained by a first retainer secured to the displacement mechanism and by a second retainer axially slidingly disposed relative to the displacement mechanism.

67. The apparatus according to claim 66, wherein the second retainer is releasably secured to the displacement mechanism, the second retainer being released for sliding displacement relative to the displacement mechanism when the displacement mechanism is displaced a predetermined distance relative to the latch mechanism.

68. The apparatus according to claim 59, wherein the the displacement mechanism is configured to displace the first member in a first direction relative to the latch mechanism, and further comprising a biasing member, the biasing member biasing the displacement mechanism in a second direction relative to the latch mechanism, the second direction being oppposite to the first direction.

69. The apparatus according to claim 68, wherein the biasing member biases the displacement mechanism toward a position in which the displacement member disengages the first member.

* * * * *